US010409191B2

(12) United States Patent
Furuta et al.

(10) Patent No.: US 10,409,191 B2
(45) Date of Patent: Sep. 10, 2019

(54) IMAGE FORMING APPARATUS

(71) Applicant: CANON KABUSHIKI KAISHA, Tokyo (JP)

(72) Inventors: Yasutomo Furuta, Abiko (JP); Izuru Horiuchi, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/466,582

(22) Filed: Mar. 22, 2017

(65) Prior Publication Data

US 2017/0285510 A1 Oct. 5, 2017

(30) Foreign Application Priority Data

Mar. 29, 2016 (JP) ..... 2016-065459

(51) Int. Cl.
*G03G 15/043* (2006.01)

(52) U.S. Cl.
CPC ..... *G03G 15/043* (2013.01)

(58) Field of Classification Search
CPC ..... G03G 15/04; G03G 15/043; G03G 15/04036; G03G 15/04045; G03G 15/04054; G03G 15/04072; H04N 1/113; H04N 1/1135; B41J 2/47; B41J 2/435; B41J 2/471; G02B 26/10; G02B 26/12; G02B 26/122; G02B 26/127
See application file for complete search history.

(56) References Cited

U.S. PATENT DOCUMENTS 8,917,305 B2 12/2014 Nakahata et al. ..... 347/244
9,261,809 B2 2/2016 Furuta ..... G03G 15/043
2008/0124125 A1* 5/2008 Hirano ..... G03G 15/326 399/151

(Continued)

FOREIGN PATENT DOCUMENTS

JP 2615668 B2 * 6/1997
JP 11188915 A * 7/1999

(Continued)

OTHER PUBLICATIONS

JP 2011148142 English machine translation, Hirano, Aug. 4, 2011.*

(Continued)

*Primary Examiner* — Carla J Therrien
(74) *Attorney, Agent, or Firm* — Venable LLP

(57) ABSTRACT

An image forming apparatus, including: a light source configured to emit a light beam; a rotary polygon mirror having a plurality of reflection surfaces configured to deflect the light beam; a beam detector configured to receive the light beam to output a pulse; a pulse interval measurement unit configured to measure a pulse interval of pulses output from the beam detector; a reflection surface identification unit configured to identify each of the plurality of reflection surfaces; a storage portion configured to store a reference pulse interval of each of the plurality of reflection surfaces; a correction amount calculation unit configured to calculate a correction amount based on the pulse interval and the reference pulse interval for each of the plurality of reflection surfaces; and a light source control unit configured to control the light source based on the correction amount.

4 Claims, 20 Drawing Sheets

(56) References Cited

U.S. PATENT DOCUMENTS

| | | | | |
|---|---|---|---|---|
| 2015/0241811 | A1* | 8/2015 | Shirahata | G02B 26/124 399/51 |
| 2016/0147170 | A1 | 5/2016 | Furuta | G03G 15/04072 |
| 2017/0019560 | A1 | 1/2017 | Horiuchi et al. | H04N 1/113 |
| 2017/0019561 | A1 | 1/2017 | Furuta | H04N 1/4052 |
| 2017/0019562 | A1 | 1/2017 | Furuta et al. | G03G 15/043 |
| 2017/0019563 | A1 | 1/2017 | Araki | H04N 1/06 |
| 2017/0019564 | A1 | 1/2017 | Horiuchi | H04N 2201/0094 |
| 2017/0038703 | A1 | 2/2017 | Horiuchi et al. | H04N 2201/0094 |
| 2017/0041489 | A1 | 2/2017 | Furuta | H04N 2201/0094 |

FOREIGN PATENT DOCUMENTS

| | | | |
|---|---|---|---|
| JP | 2004-271691 | | 9/2004 |
| JP | 2007078723 | A * | 3/2007 |
| JP | 2011148142 | A * | 8/2011 |

OTHER PUBLICATIONS

JP 2007078723 English machine translation, Sofue et al., Mar. 29, 2007.*
JP 2615668 English machine translation, Jun. 4, 1997.*
Machine Translation of JP H11-188915. (Year: 1999).*
U.S. Appl. No. 15/461,206, filed Mar. 16, 2017.
U.S. Appl. No. 15/462,532, filed Mar. 17, 2017.
U.S. Appl. No. 15/459,951, filed Mar. 15, 2017.

* cited by examiner

MAIN SCANNING POSITIONS ARE SHIFTED IN ADVANCE DIRECTION

MAIN SCANNING POSITIONS ARE SHIFTED IN RETURN DIRECTION

IMAGE FORMING APPARATUS

BACKGROUND OF THE INVENTION

Field of the Invention

The present invention relates to an image forming apparatus which includes a rotary polygon mirror.

Description of the Related Art

Hitherto, it has been generally known that electrophotographic image forming apparatus such as a laser printer and a copying machine include a light scanning apparatus configured to scan a photosensitive drum with a light beam to form an electrostatic latent image on the photosensitive drum. The light scanning apparatus includes a light source configured to emit a light beam, a collimator lens configured to collimate the light beam emitted from the light source, a rotary polygon mirror configured to deflect the collimated light beam, and an fθ lens configured to form an image of the deflected light beam on the photosensitive drum. In order to fix a writing start position of the electrostatic latent image in a main scanning direction on the photosensitive drum, the light beam deflected by the rotary polygon mirror is detected by a beam detector, and an emitting start timing of the light beam is determined based on a detection timing of the light beam by the beam detector as a reference.

The rotary polygon mirror has a plurality of reflection surfaces. The reflection surfaces may have different angles and degrees of flatness due to manufacture tolerance. Thus, when the emitting start timings of the light beam are determined based on a detection result of the beam detector configured to detect the light beam deflected by the reflection surfaces of the rotary polygon mirror, there is a problem in that fluctuation in angles and degrees of flatness of the reflection surfaces may cause deviations of writing start positions of the electrostatic latent images to be formed on the photosensitive drum. The deviations of writing start positions caused by the tolerance in angles and degrees of flatness of the reflection surfaces of the rotary polygon mirror may occur repeatedly in one rotation cycle of the rotary polygon mirror.

To cope with such a problem, in Japanese Patent Application Laid-Open No. 2004-271691, there is disclosed that the emitting start timing of the light beam for each reflection surface of the rotary polygon mirror is stored in advance to control the light source based on the emitting start timing stored for each reflection surface based on the detection timing of the light beam by the beam detector as a reference.

However, there is a case where the light scanning apparatus is deformed due to a rise in internal temperature of the image forming apparatus, with the result that a position of the beam detector is shifted. The deviation of position of the beam detector causes a problem in that a writing start position for an electrostatic latent image to be formed on the photosensitive drum is shifted even when the light source is controlled based on the emitting start timing for each reflection surface stored in advance at the time of factory shipment.

FIG. 20A and FIG. 20B are views for illustrating positions of spots SP1 and SP2 of light beams LB1 and LB2 which enter the beam detector 207. In each of FIG. 20A and FIG. 20B, there are illustrated the spot SP1 of the light beam LB1 deflected by a first reflection surface of the rotary polygon mirror and the spot SP2 of the light beam LB2 deflected by a second reflection surface of the rotary polygon mirror. FIG. 20A is an illustration of positions of the spots SP1 and SP2 of the light beams LB1 and LB2 when the beam detector 207 is arranged at an ideal position. FIG. 20B is an illustration of positions of the spots SP1 and SP2 of the light beams LB1 and LB2 when the beam detector 207 is inclined from the ideal position.

The light beam LB1 and the light beam LB2 illustrated in each of FIG. 20A and FIG. 20B are shifted in a sub-scanning direction which is perpendicular to a main scanning direction of the light beams LB1 and LB2. The positional deviation of the light beam LB1 and the light beam LB2 in the sub-scanning direction is mainly caused by fluctuation (hereinafter referred to as "optical face tangle error") of angles of the reflection surfaces with respect to a rotary axis of the rotary polygon mirror due to the manufacture tolerance.

Even when scanning positions of the light beams LB1 and LB2 are shifted in the sub-scanning direction due to the optical face tangle error, timings of entry of the light spots SP1 and SP2 to a light receiving surface 208 of the beam detector 207 are fixed irrespective of the reflection surfaces as long as the beam detector 207 is arranged at the ideal position of FIG. 20A. Meanwhile, when the beam detector 207 is arranged with inclination as illustrated in FIG. 20B, the deviation of scanning positions of the light beams LB1 and LB2 in the sub-scanning direction due to the optical face tangle error causes changes in timings of entry of the light spots SP1 and SP2 which enter the light receiving surface 208 for the reflection surfaces. The inclination of the beam detector 207 as illustrated in FIG. 20B causes a deviation of timings of entry of the light spots SP1 and SP2 to the light receiving surface 208 by time T for a first reflection surface and a second reflection surface. The shift time T in timings of entry causes a deviation of writing start positions of the electrostatic latent images to be formed on the photosensitive drum for the first reflection surface and the second reflection surface.

As described above, the deviation of writing start positions of the electrostatic latent images for the reflection surfaces may cause cyclical uneven density in an image. Such an inclination of the beam detector 207 is caused by deformation of the light scanning apparatus due to the rise in internal temperature of the image forming apparatus, with the result that the deviation of writing start positions of the electrostatic latent images occurs even when a mounting position of the beam detector 207 is adjusted at the time of factory shipment. Further, when the light scanning apparatus is deformed due to the rise in internal temperature of the image forming apparatus, in addition to the inclination of the beam detector 207, there are also changes in mounting angles of optical components such as reflection mirrors and lenses configured to guide the light beam from the reflection surfaces of the rotary polygon mirror to the beam detector 207. The changes in mounting angles of the optical components such as the reflection mirrors and lenses may also cause the deviation of writing start positions of the electrostatic latent images as with the inclination of the beam detector 207.

Even when the light source is controlled based on the emitting start timings of the reflection surfaces stored in advance at the time of factory shipment as disclosed in Japanese Patent Application Laid-Open No. 2004-271691, the deviation of writing start positions of the electrostatic latent images cannot be corrected satisfactorily in the case where the position of the beam detector is changed from an initial position due to the rise in internal temperature of the image forming apparatus.

SUMMARY OF THE INVENTION

Therefore, the present invention provides an image forming apparatus which corrects a deviation of writing start position of an electrostatic latent image for each reflection surface based on a pulse of a beam detector.

In order to solve the above-mentioned problem, according to one embodiment of the present invention, there is provided an image forming apparatus, comprising:

a light source configured to emit a light beam;

a rotary polygon mirror having a plurality of reflection surfaces and being configured to deflect the light beam so that the light beam emitted from the light source scans on a surface of a photosensitive member;

a beam detector configured to receive the light beam reflected by each of the plurality of reflection surfaces to output a pulse;

a pulse interval measurement unit configured to measure a pulse interval of pulses output from the beam detector respectively corresponding to the plurality of reflection surfaces;

a reflection surface identification unit configured to identify each of the plurality of reflection surfaces;

a storage portion configured to store a reference pulse interval of each of the plurality of reflection surfaces;

a correction amount calculation unit configured to calculate a correction amount based on the pulse interval and the reference pulse interval for each of the plurality of reflection surfaces identified by the reflection surface identification unit; and a light source control unit configured to control the light source based on the correction amount calculated by the correction amount calculation unit.

Further features of the present invention will become apparent from the following description of exemplary embodiments with reference to the attached drawings.

DESCRIPTION OF THE EMBODIMENTS

Now, the embodiments of the present invention will be described with reference to the accompanying drawings.

[First Embodiment]

Now, a first embodiment will be described. In an image forming apparatus 100 according to the first embodiment, a light beam which is deflected by each reflection surface of a rotary polygon mirror 204 is detected with use of a beam detector (hereinafter referred to as "BD") 207, and an amount of deviation of writing start position is calculated based on a cycle of a BD signal output from the BD 207, to thereby correct the writing start position.

<Overall Configuration of Image Forming Apparatus>

Figure 1:
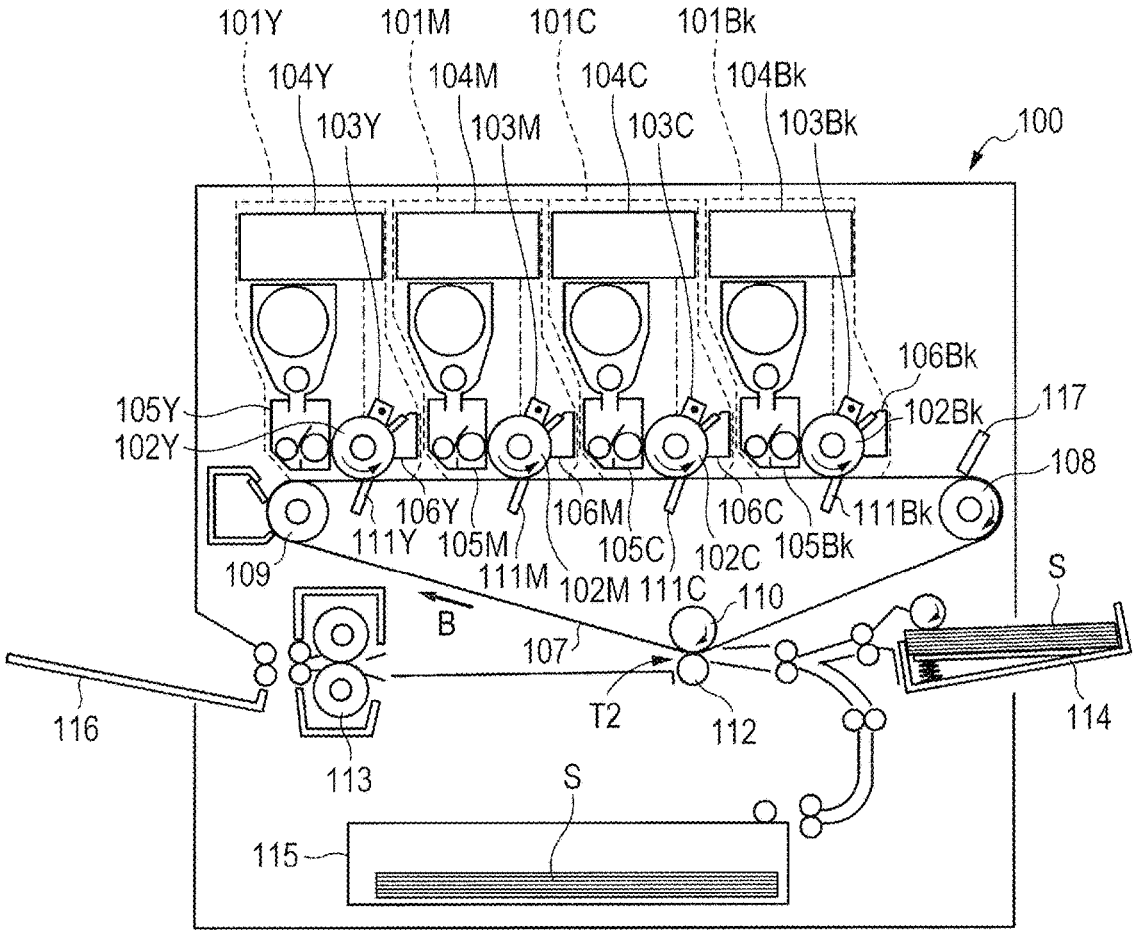
FIG. 1 is a sectional view of an image forming apparatus according to a first embodiment.

FIG. 1 is a sectional view of the image forming apparatus 100 according to the first embodiment. Description of the embodiment is made with use of a digital full color printer (color image forming apparatus), which is configured to form an image on a recording medium S with toner of a plurality of colors, as the image forming apparatus 100. The image forming apparatus 100 includes four image forming portions (image forming units) 101Y, 101M, 101C, and 101Bk which are configured to form images of respective colors. Herein, the indices Y, M, C, and Bk represent yellow, magenta, cyan, and black, respectively. The image forming portions 101Y, 101M, 101C, and 101Bk are configured to perform image formation with use of toner of yellow, magenta, cyan, and black, respectively.

The image forming portions 101Y, 101M, 101C, and 101Bk include photosensitive drums (photosensitive members) 102Y, 102M, 102C, and 102Bk being image bearing members, respectively. In peripheries of the photosensitive drums 102Y, 102M, 102C, and 102Bk, there are arranged charging devices 103Y, 103M, 103C, and 103Bk and light scanning apparatus (latent image forming units) 104Y, 104M, 104C, and 104Bk, respectively. Further, in the peripheries of the photosensitive drums 102Y, 102M, 102C, and 102Bk, there are arranged developing devices 105Y, 105M, 105C, and 105Bk and drum cleaning devices 106Y, 106M, 106C, and 106Bk, respectively. Each of the image forming portions 101 includes the photosensitive drum 102, the charging device 103, the light scanning apparatus 104, the developing device 105, and the drum cleaning device 106.

Under the photosensitive drums 102Y, 102M, 102C, and 102Bk, there is arranged an intermediate transfer belt (intermediate transfer member) 107 having an endless belt-like shape. The intermediate transfer belt 107 is stretched around a driving roller 108 and driven rollers 109 and 110, and is rotated in a direction indicated by the arrow B of FIG. 1 during an image forming operation. Further, at positions opposed to the photosensitive drums 102Y, 102M, 102C, and 102Bk through intermediation of the intermediate transfer belt 107, there are arranged primary transfer devices 111Y, 111M, 111C, and 111Bk. Further, the image forming apparatus 100 according to the embodiment includes a secondary transfer device (transfer unit) 112 and a fixing device 113. The secondary transfer device 112 is configured to transfer toner images formed on the intermediate transfer belt 107 onto the recording medium S. The fixing device 113 is configured to fix the toner images on the recording medium S.

<Image Forming Processes>

Next, a description will be provided of image forming processes of the image forming apparatus 100 from a charging step to a developing step. The image forming portions 101 perform the same image forming processes. Thus, the image forming processes of the image forming portion 101Y are described as an example, and description of the image forming processes in each of the image forming portions 101M, 101C, and 101Bk is omitted.

The charging device 103Y of the image forming portion 101Y uniformly charges a surface of the photosensitive drum 102Y being rotated. The light scanning apparatus 104Y emits laser light (hereinafter referred to as "light beam") to optically expose the uniformly charged surface of the photosensitive drum 102Y with the light beam. With this, an electrostatic latent image is formed on the photosensitive drum 102Y (on the photosensitive member) being rotated. The developing device 105Y is configured to develop the electrostatic latent image on the photosensitive drum 102Y with yellow toner to form a toner image.

Now, a description will be provided of operations of the image forming portions 101Y, 101M, 101C, and 101Bk in the image forming processes subsequent to a primary transfer step. The primary transfer devices 111Y, 111M, 111C, and 111Bk apply transfer bias to the intermediate transfer belt 107. With this, toner images of yellow, magenta, cyan, and black on the photosensitive drums 102Y, 102M, 102C, and 102Bk are primarily transferred onto the intermediate transfer belt 107 in a sequential manner. The toner images of respective colors are superimposed on one another on the intermediate transfer belt 107. Residual toner on the photosensitive drums 102Y, 102M, 102C, and 102Bk after the primary transfer is removed by the drum cleaning devices 106Y, 106M, 106C, and 106Bk. The toner images of four colors superimposed on the intermediate transfer belt 107 are secondarily transferred by the secondary transfer device 112 onto the recording medium S which is conveyed from a manual feeding cassette 114 or a sheet feeding cassette 115 to a secondary transfer portion T2. The fixing device 113 heats and presses the toner images on the recording medium S to fix the toner images on the recording medium S, thereby forming a full color image. The recording medium S having the full color image formed thereon is delivered to a delivery portion 116.

<Light Scanning Apparatus>

Figure 2:
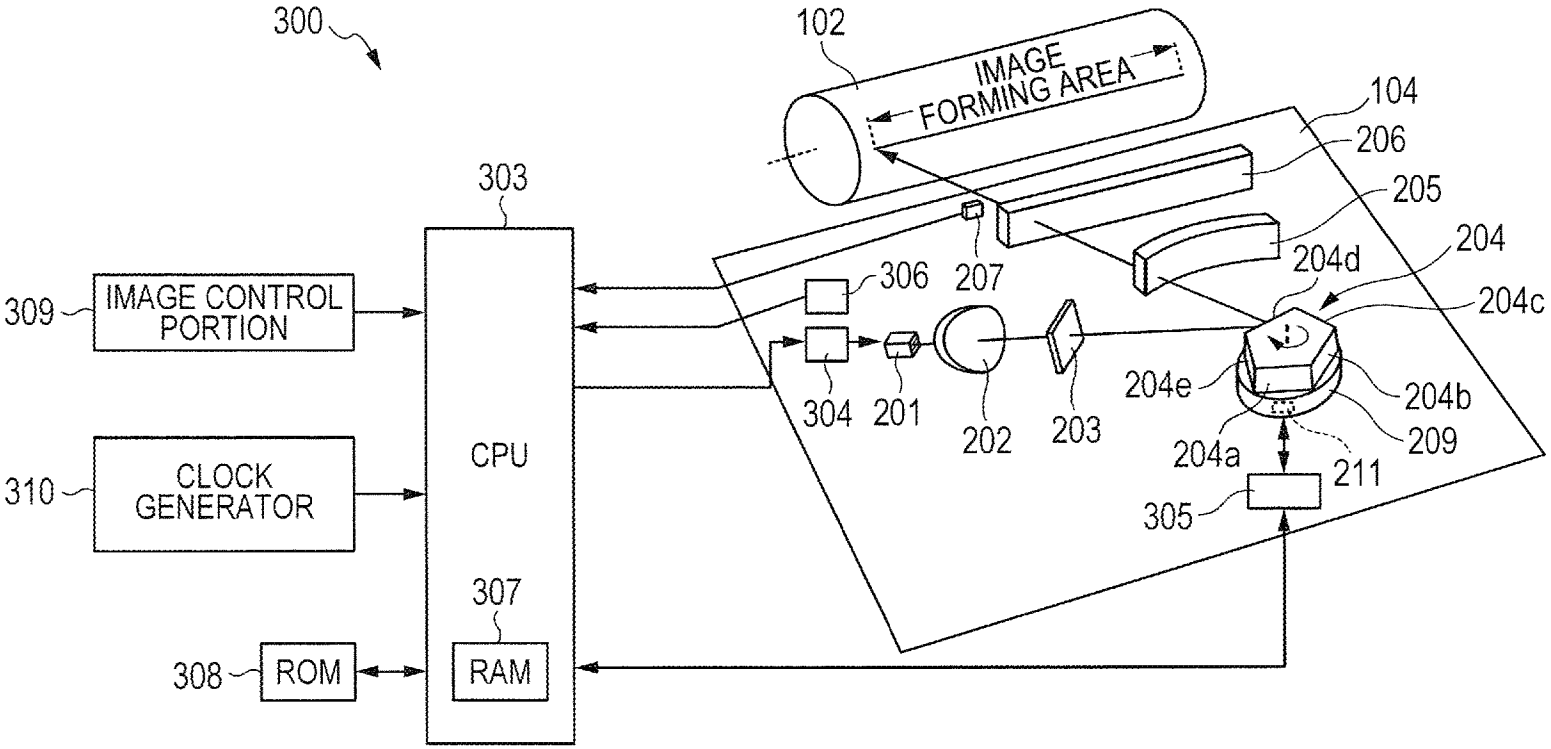
FIG. 2 is a view for illustrating a light scanning apparatus of the first embodiment.

Next, with reference to FIG. 2, the light scanning apparatus 104 will be described. FIG. 2 is a view for illustrating the light scanning apparatus 104 according to the first embodiment. The light scanning apparatus 104Y, 104M, 104C, and 104Bk have the same configuration. Thus, the indices Y, M, C, and Bk indicating colors are omitted in the following description. FIG. 2 is a view for schematically illustrating the photosensitive drum 102, the light scanning apparatus 104 configured to emit the light beam to the photosensitive drum 102, and a control portion (hereinafter referred to as "CPU") 303 configured to control the light scanning apparatus 104.

The light scanning apparatus 104 includes a semiconductor laser (hereinafter referred to as "light source") 201 configured to emit the light beam, a collimator lens 202, a cylindrical lens 203, a rotary polygon mirror 204, and fθ lenses 205 and 206. In the embodiment, the light source 201 is a multi-beam laser light source having a plurality of light emitting points and being configured to emit a plurality of light beams. In the embodiment, the number of light emitting points of the light source 201 is eight. However, the light source 201 is not limited to this, and may have seven or less or nine or more light emitting points. Alternatively, the light source 201 may be a light source having a single light emitting point and being configured to emit a single light beam. The collimator lens 202 is configured to collimate the light beam emitted from the light source 201. The cylindrical lens 203 is configured to condense the light beam, which has passed through the collimator lens 202, in a sub-scanning direction, that is, a direction corresponding to a rotating direction of the photosensitive drum 102.

The rotary polygon mirror 204 has a plurality of reflection surfaces. In the embodiment, the rotary polygon mirror 204 has five reflection surfaces 204*a*, 204*b*, 204*c*, 204*d*, and 204*e*, but is not limited thereto. The rotary polygon mirror 204 may have three, four, six, or seven or more reflection surfaces. The rotary polygon mirror 204 is mounted to a motor shaft of a motor portion 209 being rotated, and is integrally rotated with the motor portion 209. Each of the reflection surfaces 204*a*, 204*b*, 204*c*, 204*d*, and 204*e* of the rotary polygon mirror 204 is configured to deflect the light beam from the cylindrical lens 203 in a main scanning direction, that is, a direction parallel to the rotary shaft of the photosensitive drum 102. The main scanning direction is a direction orthogonal to the sub-scanning direction. The light beam having been deflected by the rotary polygon mirror 204 enters the fθ lens 205 and the fθ lens 206. The fθ lens 205 and the fθ lens 206 are configured to form an image of the light beam on the surface of the photosensitive drum 102.

The light scanning apparatus 104 includes the BD 207 configured to receive the light beam outside of an image forming area of the photosensitive drum 102. The BD 207 is a signal generating unit configured to receive the light beam having been deflected by the rotary polygon mirror 204 and output a horizontal synchronization signal (hereinafter referred to as "BD signal"). The BD signal is used to control an emitting start timing of the light beam based on an image signal for one scanning so as to fix a writing start position of an electrostatic latent image in the main scanning direction on the photosensitive drum.

The light beam emitted from the light scanning apparatus 104 scans the surface of the photosensitive drum 102 in the main scanning direction. The light scanning apparatus 104 is positioned with respect to the photosensitive drum 102 so that the light beam scans in the main scanning direction parallel to the rotary shaft of the photosensitive drum 102.

The light source 201 emits a plurality of light beams. Thus, scanning lines corresponding to the number of the light emitting points of the light source 201 are simultaneously formed per one scanning by one reflection surface of the rotary polygon mirror 204. In the embodiment, the number of light emitting points of the light source 201 is eight. Thus, electrostatic latent images corresponding to eight scanning lines are formed in one scanning. Further, the number of the reflection surfaces of the rotary polygon mirror 204 is five. Thus, in one rotation of the rotary polygon mirror 204, scanning is performed for five times, and hence electrostatic latent images of forty scanning lines are formed.

<Control System>

Next, a description will be provided of a control system 300 configured to control the light scanning apparatus 104. The control system 300 includes a CPU 303 configured to control the light scanning apparatus 104. The CPU 303 may be arranged in the light scanning apparatus 104 or in a main body of the image forming apparatus 100. The CPU 303 is electrically connected to an image control portion 309. The image control portion 309 is configured to generate image data and input the generated image data to the CPU 303. Further, the CPU 303 receives input of CLK signals (clock) output from a clock generator 310. The CPU 303 includes a ROM (storage portion) 308 and an internal RAM (storage portion) 307. The ROM 308 is configured to store a main program and a sub program. The RAM 307 is configured to store data which is required during execution of the programs. Further, the CPU 303 is electrically connected to the BD 207, a memory (storage portion) 306, a light source drive circuit 304, and a motor drive portion 305. It is preferred that the memory 306, the light source drive circuit 304, and the motor drive portion 305 be arranged in the light scanning apparatus 104. The CPU 303 performs detection of a writing start position of a scanning line based on the BD signal output from the BD 207.

A motor portion 209 of the rotary polygon mirror 204 includes a Hall element (FG pulse generation unit) 211. The Hall element is arranged so as to be opposed to a magnet arranged in a rotor (rotator) of the motor portion 209, and is configured to output a signal in accordance with a change in magnetic force caused by rotation of the motor portion 209. The output of the Hall element 211 is converted into a digital signal by the motor drive portion 305. The motor drive portion 305 outputs, to the CPU 303, the digital signal as an FG signal of four pulses per rotation of the rotary polygon mirror 204. The Hall element 211 and the motor drive portion 305 serve as a pulse generation unit configured to generate pulses (FG signals) in accordance with a rotational speed of the rotary polygon mirror 204. The CPU 303 measures a time interval between pulses of the FG signal to detect the rotational speed of the rotary polygon mirror 204. The CPU 303 generates an acceleration and deceleration signal to control the rotational speed of the motor portion 209 based on the FG signal. The CPU 303 outputs the acceleration and deceleration signal to the motor drive portion 305 to control the motor drive portion 305 so that the rotary polygon mirror 204 is rotated at a predetermined speed. The motor drive portion 305 supplies a drive current to the motor portion 209 in accordance with the acceleration and deceleration signal to drive the motor portion 209.

After the rotational speed of the rotary polygon mirror 204 settles at the predetermined speed, the CPU 303 instructs the light source drive circuit 304 to start emission of the light beam from the light source 201. When the light beam scans on the BD 207, the BD 207 outputs a BD signal to the CPU 303. When the BD signal is input, the CPU 303 instructs the light source drive circuit 304 to stop emission of the light beam from the light source 201. Based on an input timing of the BD signal, the CPU 303 determines a timing at which the light beam deflected by the reflection surface of the rotary polygon mirror 204 scans on the BD 207, to thereby determine an emitting timing of the light beam for detection of the BD signal. The CPU 303 controls the light source 201 to start emission of the light beam at a timing immediately before entry of the light beam to the BD 207. When the BD signal is input, the CPU 303 controls the light source 201 to stop emission of the light beam. As described above, the CPU 303 controls the light source 201 so that the BD signal is output for each of the reflection surfaces of the rotary polygon mirror 204.

As described above, the light source 201 is a multi-beam laser light source including a plurality of light emitting points and being configured to emit a plurality of light beams. In the multi-beam laser light source, the plurality of light beams are adjusted to a predetermined interval. Thus, based on a BD signal obtained through emission of a light beam from any one of the light emitting points, the emitting start timings of other light beams based on the image signal for one scanning can be calculated. In the embodiment, a light beam is emitted from one light emitting point selected in advance, and the one light beam is scanned on the BD 207, with the result that the BD signal of one pulse is generated from the BD 207 for each scanning. The output BD signal is input to the CPU 303. When a TOP signal as a synchronization signal in the sub-scanning direction for printing of a top part of an image at an appropriate position on the recording medium S is input from the image control portion 309, the CPU 303 transmits image data to the light source drive circuit 304 based on an input timing of the BD signal of the BD 207. The light source drive circuit 304 controls the light source 201 to emit the light beam based on the input image data.

The memory 306 stores emitting start timing reference data RT (RT1, RT2, RT3, RT4, and RT5) corresponding respectively to the reflection surfaces 204*a*, 204*b*, 204*c*, 204*d*, and 204*e* of the rotary polygon mirror 204. The CPU 303 reads the emitting start timing reference data RT from the memory 306 before image formation, and corrects the emitting start timings (writing start timings). In the following, the correction of the emitting start timings will be described.

<Correction Processing for Emitting Start Timings>

Figure 3:
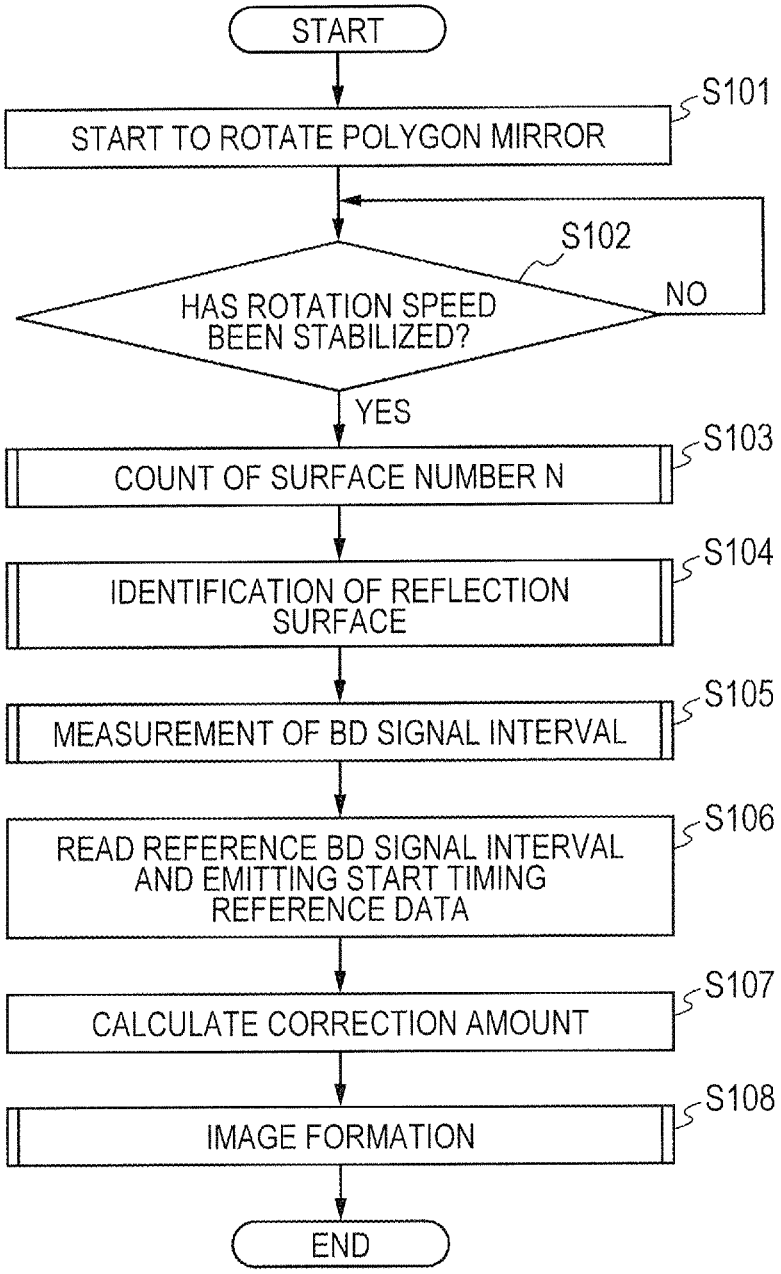
FIG. 3 is a flowchart for illustrating correction processing for emitting start timings, which is executed by a CPU of the first embodiment.

FIG. 3 is a flowchart for illustrating correction processing for the emitting start timings, which is executed by the CPU 303 of the first embodiment. The CPU 303 executes the correction processing for the emitting start timings of the light beam based on the main program stored in the ROM 308. When a print job is started, the CPU 303 outputs an acceleration signal to the motor drive portion 305 to start rotation of the rotary polygon mirror 204 (Step S101). The CPU 303 determines whether or not the rotational speed of the rotary polygon mirror 204 has been stabilized at a predetermined speed (Step S102). When the rotational speed of the rotary polygon mirror 204 is within a predetermined range including the predetermined speed for a predetermined period of time, the CPU 303 determines that the rotational speed of the rotary polygon mirror 204 has been stabilized at the predetermined speed. When it is not determined that the rotational speed of the rotary polygon mirror 204 has been stabilized at the predetermined speed (NO in Step S102), the CPU 303 returns the processing to Step S102. When it is determined that the rotational speed of the rotary polygon mirror 204 has been stabilized at the predetermined speed (YES in Step S102), the CPU 303 proceeds the processing to Step S103.

The CPU 303 starts counting of surface numbers N of the reflection surfaces 204*a*, 204*b*, 204*c*, 204*d*, and 204*e* of the rotary polygon mirror 204 (Step S103). The CPU 303 allocates a surface number 1 to a BD signal input immediately after the processing proceeds to Step S103, and allocates surface numbers 2, 3, 4, and 5 to subsequently input BD signals in a sequential manner. The CPU 303 is a control portion capable of performing parallel processing, and continues updating a surface number N each time the BD signal is input until the print job is completed. Counting of the surface numbers N, which is executed in parallel with the print job, will be described later.

When counting of the surface numbers N is started, the CPU 303 performs identification of the reflection surfaces 204*a*, 204*b*, 204*c*, 204*d*, and 204*e* of the rotary polygon mirror 204 (Step S104). In order to identify the reflection surfaces 204*a*, 204*b*, 204*c*, 204*d*, and 204*e*, the CPU 303 measures time intervals Tbdfg (Tbdfg1, Tbdfg2, Tbdfg3, Tbdfg4, and Tbdfg5) of the BD signals (BD pulses) and the FG signals (FG pulses). The CPU 303 makes reference surface numbers Nref correspond to the surface numbers N, which are counted in Step S103, based on the measured time intervals. The identification of the reflection surfaces 204*a*, 204*b*, 204*c*, 204*d*, and 204*e* will be described later.

The CPU 303 performs measurement of BD signal intervals (BD pulse cycles) Tbdbd (Tbdbd1, Tbdbd2, Tbdbd3, Tbdbd4, and Tbdbd5) corresponding to the surface numbers N (surface numbers 1, 2, 3, 4, and 5) (Step S105). The measurement of the BD signal intervals Tbdbd will be described later.

The CPU 303 reads reference BD signal intervals Tref (Tref1, Tref2, Tref3, Tref4, and Tref5) corresponding to the reference surface numbers Nref (reference surface numbers 1, 2, 3, 4, and 5) from the memory 306 (Step S106). The reference BD signal intervals Tref will be described later. At this time, the CPU 303 also reads emitting start timing reference data RT (RT1, RT2, RT3, RT4, and RT5) corresponding to the reference surface numbers Nref from the memory 306 (Step S106). The CPU 303 stores the reference BD signal intervals Tref and the emitting start timing reference data RT, which have been read, in the RAM 307.

Based on the BD signal intervals Tbdbd and the reference BD signal intervals Tref, the CPU 303 calculates correction amounts Tofset (Tofset1, Tofset2, Tofset3, Tofset4, and Tofset5) corresponding to the reference surface numbers Nref (Step S107). The CPU 303 stores the calculated correction amounts Tofset in the RAM 307. The calculation of the correction amounts Tofset corresponding to the reference surface numbers Nref will be described later.

The CPU 303 executes the image formation with use of the correction amounts Tofset (Step S108). In the first embodiment, the emitting start timings of the light beam is corrected with use of the correction amounts Tofset. The image formation with use of the correction amounts Tofset will be described later. The CPU 303 completes the print job.

In the embodiment, the correction amounts Tofset are calculated before the image formation. However, the present invention is not necessarily limited to this. The correction amounts Tofset may be calculated during the image formation. In that case, for example, the processing from Step S103 to Step S107 of FIG. 3 may be executed in parallel with the image formation in Step S108 of FIG. 3. The internal temperature of the image forming apparatus 100 rises as the number of sheets subjected to the image formation increases. Thus, it is effective to calculate the correction amounts Tofset during the image formation and correct the emitting start timings of the light beam. Further, when images are successively formed on a plurality of recording media S, the correction amounts Tofset may be calculated between a recording medium S and a recording medium S (what is called a sheet-to-sheet interval).

(Counting of Surface Numbers N)

Figure 4:
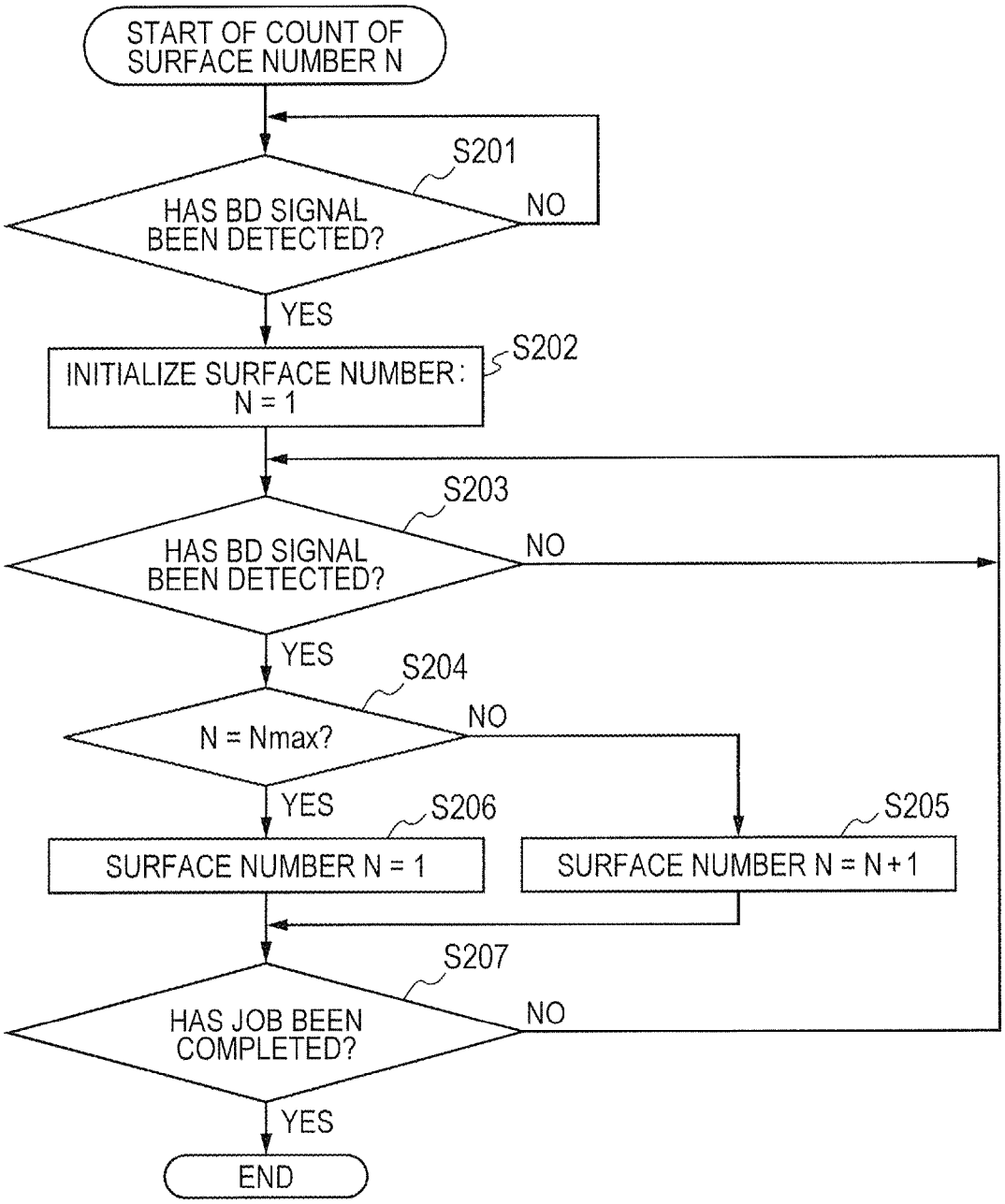
FIG. 4 is a flowchart for illustrating counting of surface numbers, which is executed by the CPU of the first embodiment.

Next, with reference to FIG. 4, counting of the surface numbers N in Step S103 of FIG. 3 will be described. FIG. 4 is a flowchart for illustrating counting of the surface numbers N, which is executed by the CPU 303 of the first embodiment. The CPU 303 executes counting of the surface numbers N based on the program stored in the ROM 308. In the embodiment, the CPU 303 allocates the surface number 1 to a reflection surface corresponding to the BD signal input immediately after the processing proceeds to Step S103 of FIG. 3, and allocates numbers to reflection surfaces corresponding to subsequently input BD signals in a sequential manner.

When counting of the surface numbers N is started, the CPU 303 determines whether or not the BD signal has been detected (Step S201). When the BD signal has not been detected (NO in Step S201), the CPU 303 returns the processing to Step S201. When the BD signal has been detected (YES in Step S201), the CPU 303 substitutes 1 for the surface number N to initialize the surface number (Step S202). Next, the CPU 303 determines whether or not the BD signal has been detected (Step S203). When the BD signal has not been detected (NO in Step S203), the CPU 303 returns the processing to Step S203. When the BD signal has been detected (YES in Step S203), the CPU 303 determines whether or not the surface number N is a number of surfaces Nmax (Step S204). The number of surfaces Nmax is the number of the reflection surfaces 204*a*, 204*b*, 204*c*, 204*d*, and 204*e* of the rotary polygon mirror 204. In the embodiment, the number of the reflection surfaces 204*a*, 204*b*, 204*c*, 204*d*, and 204*e* of the rotary polygon mirror 204 is five. Thus, the number of surfaces Nmax is 5.

When the surface number N is not the number of surfaces Nmax (NO in Step S204), the CPU 303 adds 1 to the surface number N (Step S205). The CPU 303 updates the surface number N stored in the RAM 307 and proceeds the processing to Step S207. Meanwhile, when the surface number N is the number of surfaces Nmax (YES in Step S204), the CPU 303 substitutes 1 for the surface number N (Step S206). The CPU 303 updates the surface number N stored in the RAM 307 and proceeds the processing to Step S207. The CPU 303 determines whether or not the print job has been completed (Step S207). When the print job has not been completed (NO in Step S207), the CPU 303 returns the processing to Step S203 and continues counting of the surface numbers N. When the print job has been completed (YES in Step S207), the CPU 303 completes counting of the surface numbers N. As described above, the CPU 303 updates the surface number N stored in the RAM 307 each time the BD signal is input during the execution of the print job.

(Identification of Reflection Surfaces)

Next, the identification of the reflection surfaces in Step S104 of FIG. 3 will be described. When the number of BD signals and the number of FG signals per rotation of the rotary polygon mirror 204 are in the relationship of being prime to each other, the time intervals Tbdfg of the BD signals and the FG signals are different for the reflection surfaces 204*a*, 204*b*, 204*c*, 204*d*, and 204*e*. Therefore, through measurement of the time intervals Tbdfg of the BD signals and the FG signals, a reflection surface being currently used for scanning can be identified. In the embodiment, the time intervals Tbdfg of the BD signals and the FG signals are measured with respect to the above-mentioned surface numbers N determined immediately after the start of rotation of the rotary polygon mirror 204. Based on the time intervals Tbdfg measured for the surface numbers N, the surface numbers N are made to correspond to the reference surface numbers Nref. With this, it can be identified that the reflection surface currently being used for scanning with the light beam corresponds to which of the reference surface numbers Nref.

Figure 5:
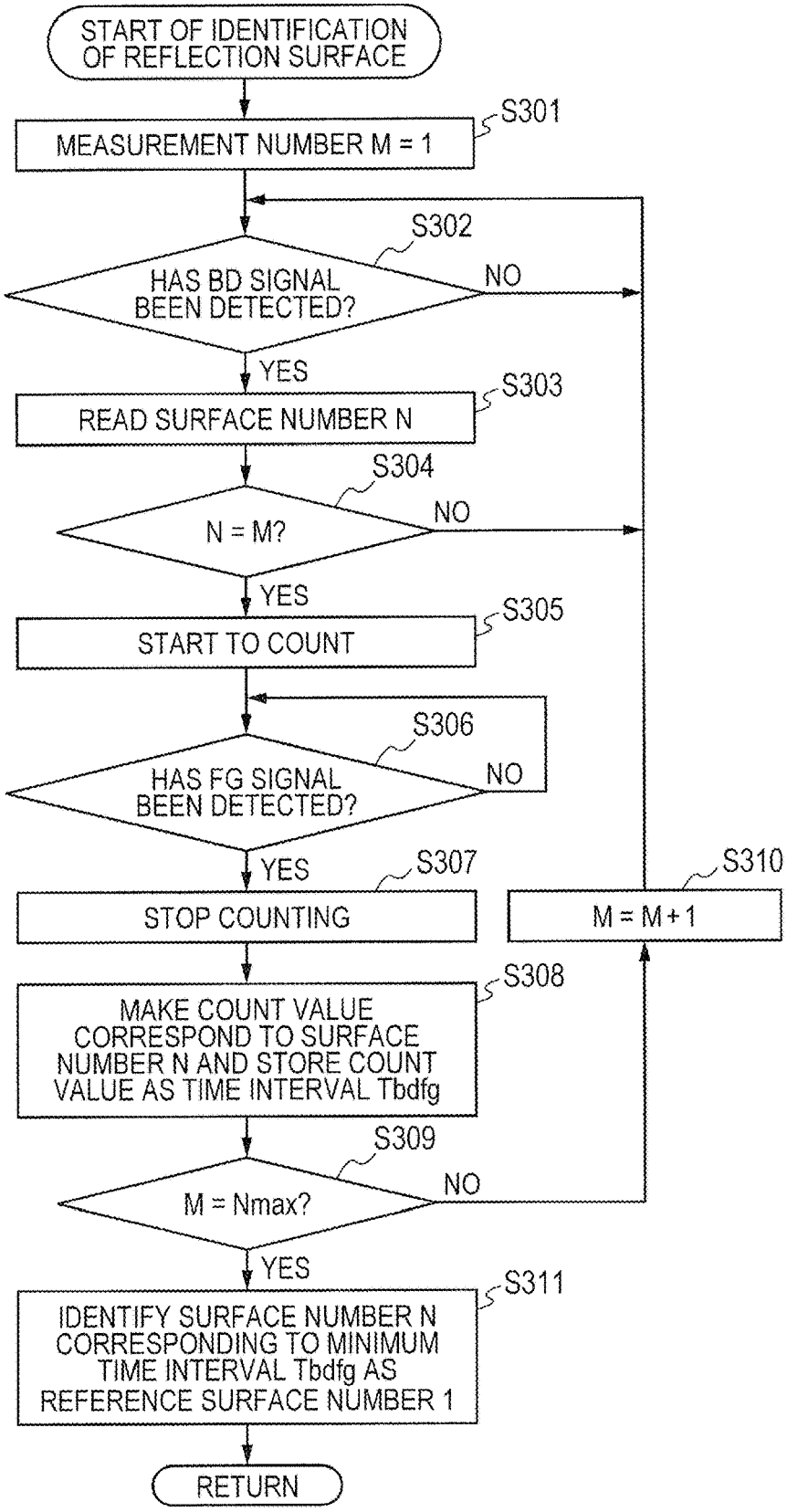
FIG. 5 is a flowchart for illustrating identification of reflection surfaces, which is executed by the CPU of the first embodiment.

With reference to FIG. 5, the identification of the reflection surfaces in Step S104 of FIG. 3 will be described. FIG. 5 is a flowchart for illustrating the identification of the reflection surface, which is executed by the CPU 303 of the first embodiment. The CPU 303 executes the identification of the reflection surface based on the program stored in the ROM 308. The CPU 303 serves as a reflection surface identification unit configured to identify the plurality of reflection surfaces of the rotary polygon mirror 204 based on the BD signals and the FG signals.

When the identification of the reflection surfaces is started, the CPU 303 substitutes 1 for a measurement number M (Step S301). The CPU 303 determines whether or not the BD signal has been detected (Step S302). When the BD signal has not been detected (NO in Step S302), the CPU 303 returns the processing to Step S302. When the BD signal has been detected (YES in Step S302), the CPU 303 reads the surface number N stored in the RAM 307 (Step S303). The surface number N of the reflection surface of the rotary polygon mirror 204 is updated by the CPU 303 each time the BD signal is input as described above. The CPU 303 determines whether or not the surface number N matches with the measurement number M (Step S304). When the surface number N does not match with the measurement number M (NO in Step S304), the CPU 303 returns the processing to Step S302. When the surface number N matches with the measurement number M (YES in Step S304), the CPU 303 starts counting in accordance with CLK signals (clock) input from the clock generator 310 (Step S305).

The CPU 303 determines whether or not the FG signal has been detected (Step S306). When the FG signal has not been detected (NO in Step S306), the CPU 303 returns the processing to Step S306. When the FG signal has been detected (YES in Step S306), the CPU 303 stops counting (Step S307). The CPU 303 makes the count value correspond to the surface number N, and stores the same as the time interval Tbdfg between the BD signal and the FG signal in the RAM 307 (Step S308). The CPU 303 determines whether or not the measurement number M matches with the number of surfaces Nmax (Step S309). When the measurement number M does not match with the number of surfaces Nmax (NO in Step S309), the CPU 303 adds 1 to the measurement number M (Step S310), and returns the processing to Step S302. The CPU 303 repeats the processing from Step S302 to Step S310 until the measurement number M matches with the number of surfaces Nmax. With this, the time intervals Tbdfg1, Tbdfg2, Tbdfg3, Tbdfg4, and Tbdfg5 of the BD signals and the FG signals corresponding to the surface numbers 1, 2, 3, 4, and Nmax, specifically, Nmax=5 in the embodiment, respectively, are measured, and stored in the RAM 307. When the measurement number M matches with the number of surfaces Nmax (YES in Step S309), the CPU 303 proceeds the processing to Step S311.

The CPU 303 compares the measured time intervals Tbdfg1 to Tbdfg5, and identifies the surface number N corresponding to the minimum time interval (count value) Tbdfg as the reference surface number 1 (Step S311). The surface numbers subsequent to the surface number N identified as the reference surface number 1 are made to correspond to reference surface numbers 2, 3, 4, and 5 in a sequential manner. For example, when the surface number 4 is identified as the reference surface number 1, the surface numbers 5, 1, 2, and 3 are made to correspond to the reference surface numbers 2, 3, 4, and 5, respectively. With this, the surface numbers N are made to correspond to the reference surface numbers Nref, with the result that the reflection surfaces 204*a*, 204*b*, 204*c*, 204*d*, and 204*e* of the rotary polygon mirror 204 being rotated are identified. The CPU 303 returns the processing to the main program of FIG. 3.

Herein, the reference surface numbers Nref are uniquely determined based on a relationship of the time intervals Tbdfg of the BD signals and the FG signals irrespective of the rotational speed of the rotary polygon mirror 204. In the embodiment, the surface number N of the reflection surface which corresponds to the minimum time interval among the time intervals Tbdfg for the reflection surfaces measured at a normal temperature during adjustment step in a factory is defined as the reference surface number 1 (identification reference surface). The definition that the surface number N corresponding to the minimum time interval is set as the reference surface number 1 is stored as a reference data in the memory 306. Thus, the surface number N with the minimum time interval Tbdfg of the BD signals and the FG signals measured during identification of the reflection surfaces is identified as the reference surface number 1. However, as long as the definition for the reference surface number Nref during the adjustment step in a factory is the same as the definition for the reference surface number Nref given when the CPU 303 executes identification of the reflection surfaces, another identification method may be used. For example, when it is defined that the surface number N of the reflection surface corresponding to the maximum time interval during the adjustment step in a factory is the reference surface number 1, the surface number N with the maximum time interval Tbdfg measured during identification of the reflection surfaces may be identified as the reference surface number 1.

Figure 6:
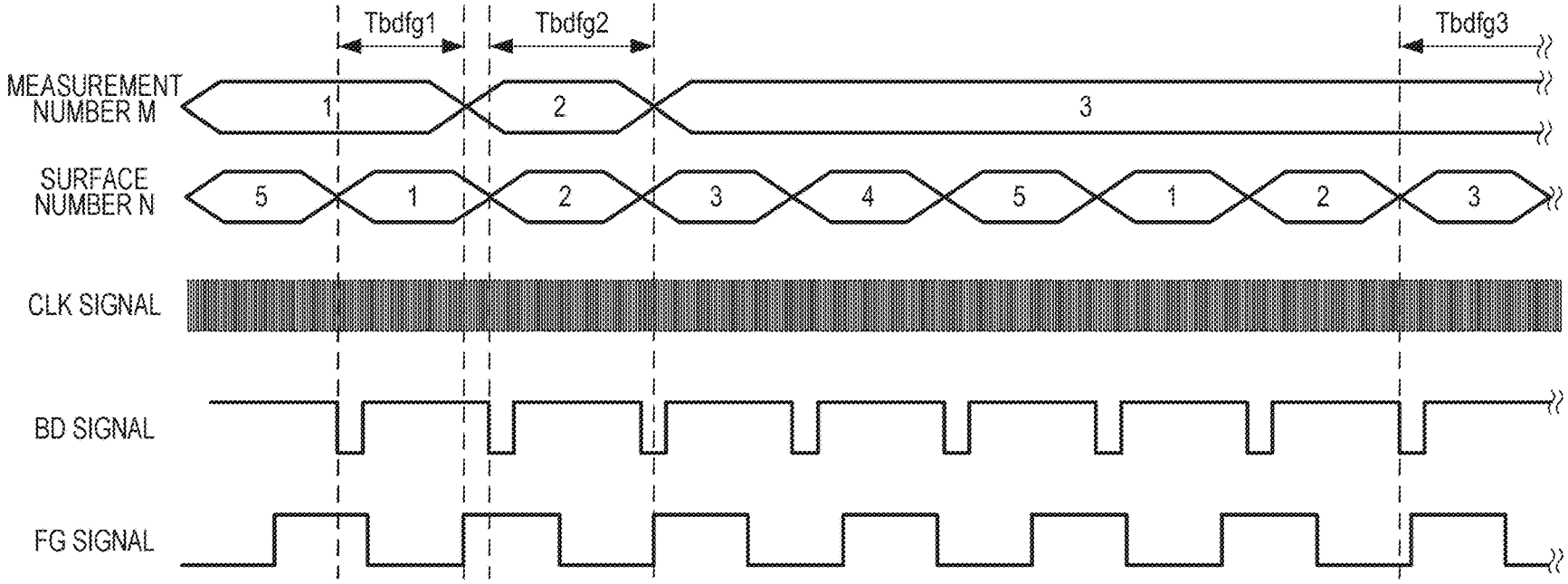
FIG. 6 is a time chart for identification of the reflection surfaces, which is executed by the CPU of the first embodiment.

With reference to FIG. 6, a description will be provided of a relationship among the measurement numbers M, the surface numbers N, the CLK signals, the BD signals, the FG signals, and the time intervals Tbdfg for identification of the reflection surfaces. FIG. 6 is a time chart for illustrating identification of the reflection surfaces, which is executed by the CPU 303 of the first embodiment. First, when the measurement number M is 1, at a timing at which the surface number N becomes 1, measurement of the time interval Tbdfgl of the BD signal and the FG signal is performed based on the CLK signals. When the measurement number M is 2, at a timing at which the surface number N becomes 2, measurement of the time interval Tbdfg2 of the BD signal and the FG signal is performed based on the CLK signals. Similarly, when the measurement numbers M are 3, 4, and 5, the time intervals Tbdfg3, Tbdfg4, and Tbdfg5 are measured in a sequential manner. In such a manner, the time intervals Tbdfg1 to Tbdfg5 of the BD signals and the FG signals are measured in association with the surface numbers 1 to 5.

As described above, the time intervals Tbdfg of the BD signals and the FG signals are measured in association with the surface numbers N of the reflection surfaces of the rotary polygon mirror 204 being rotated, and are made to correspond to the reference surface numbers 1 to 5 in the order from the surface number N having the minimum time interval Tbdfg. In the manner as described above, the reflection surfaces of the rotary polygon mirror 204 being rotated can be identified as the reference surface numbers 1 to 5.

In the embodiment, the CPU 303 identifies the reflection surfaces based on the BD signals and the FG signals. However, as the reflection surface identification unit, there may be employed a configuration of detecting marks provided on the rotary polygon mirror 204 to identify the reflection surface.

(Measurement of BD Signal Intervals)

Figure 7:
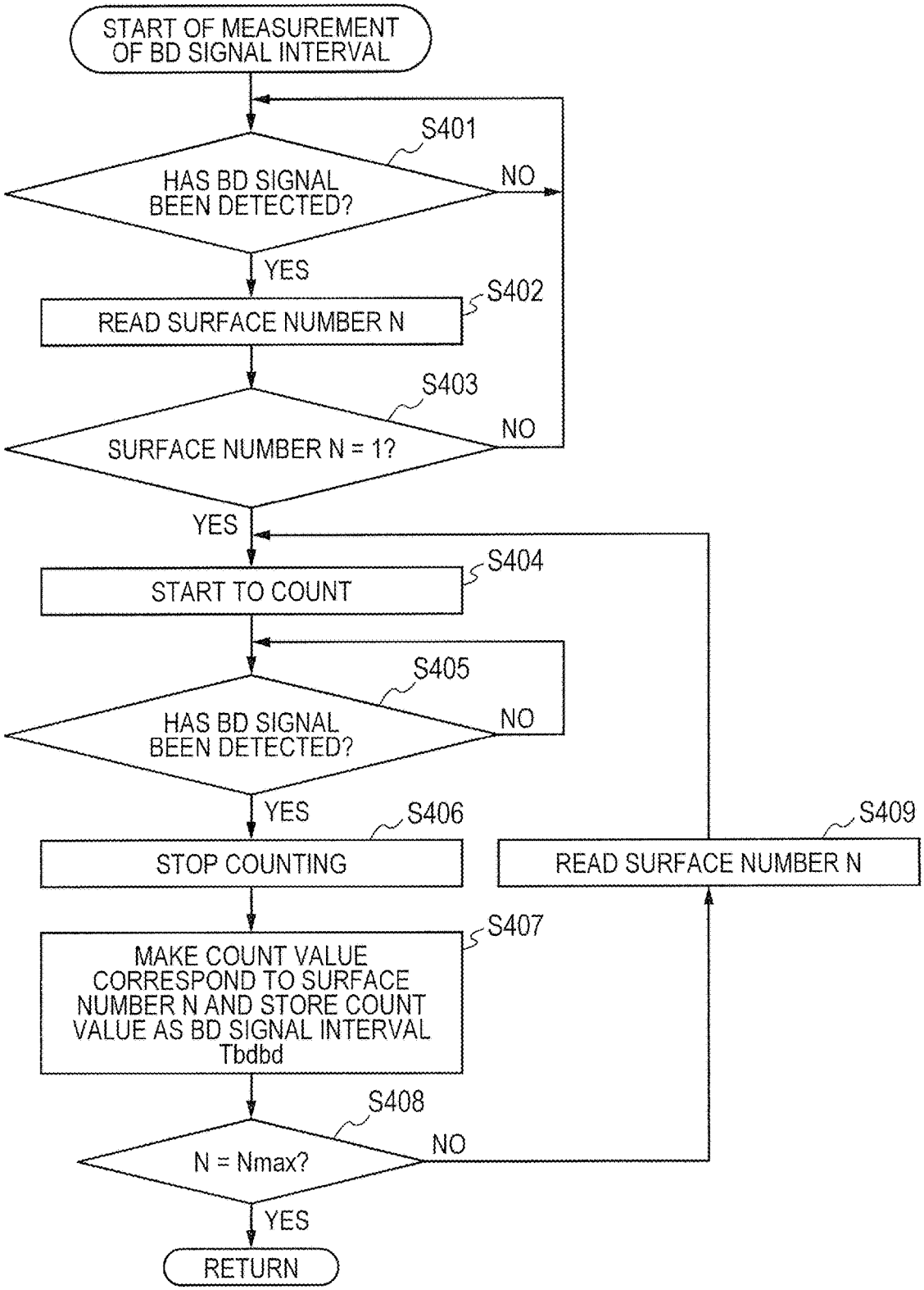
FIG. 7 is a flowchart for illustrating measurement of BD signal intervals, which is executed by the CPU of the first embodiment.

Next, with reference to FIG. 7, a description will be provided of measurement of the BD signal intervals Tbdbd in Step S105 of FIG. 3. FIG. 7 is a flowchart for illustrating the measurement of the BD signal intervals Tbdbd, which is executed by the CPU 303 of the first embodiment. The CPU 303 executes the measurement of the BD signal intervals Tbdbd based on the program stored in the ROM 308. The CPU 303 functions as a pulse interval measurement unit configured to measure time intervals of the BD signals (BD pulses).

When the measurement of the BD signal intervals Tbdbd is started, the CPU 303 determines whether or not the BD signal has been detected (Step S401). When the BD signal has not been detected (NO in Step S401), the CPU 303 returns the processing to Step S401. When the BD signal has been detected (YES in Step S401), the CPU 303 reads the surface number N stored in the RAM 307 (Step S402). The surface number N of the reflection surface of the rotary polygon mirror 204 is updated by the CPU 303 each time the BD signal is input as described above. The CPU 303 determines whether or not the surface number N is 1 (Step S403). When the surface number N is not 1 (NO in Step S403), the CPU 303 returns the processing to Step S401. When the surface number N is 1 (YES in Step S403), the CPU 303 starts counting in accordance with the CLK signals (clock) input from the clock generator 310 (Step S404).

The CPU 303 determines whether or not the BD signal has been detected (Step S405). When the BD signal has not been detected (NO in Step S405), the CPU 303 returns the processing to Step S405. When the BD signal has been detected (YES in Step S405), the CPU 303 stops counting (Step S406). The CPU 303 makes the count value correspond to the surface number N, and stores the same as the BD signal interval Tbdbd in the RAM 307 (Step S407). The CPU 303 determines whether or not the surface number N is the number of surfaces Nmax (Step S408).

When the surface number N is not the number of surfaces Nmax (NO in Step S408), the CPU 303 reads the updated surface number N from the RAM 307 (Step S409), and returns the processing to Step S404. The CPU 303 repeats the processing from Step S404 to Step S409 until the surface numbers N matches with the number of surfaces Nmax. With this, the BD signal intervals Tbdbd1, Tbdbd2, Tbdbd3, Tbdbd4, and Tbdbd5 corresponding to the surface numbers 1, 2, 3, 4, and Nmax, specifically, Nmax=5 in the embodiment, are measured, and stored in the RAM 307. When the surface number N is the number of surfaces Nmax (YES in Step S408), the CPU 303 returns the processing to the main program of FIG. 3.

Figure 8:
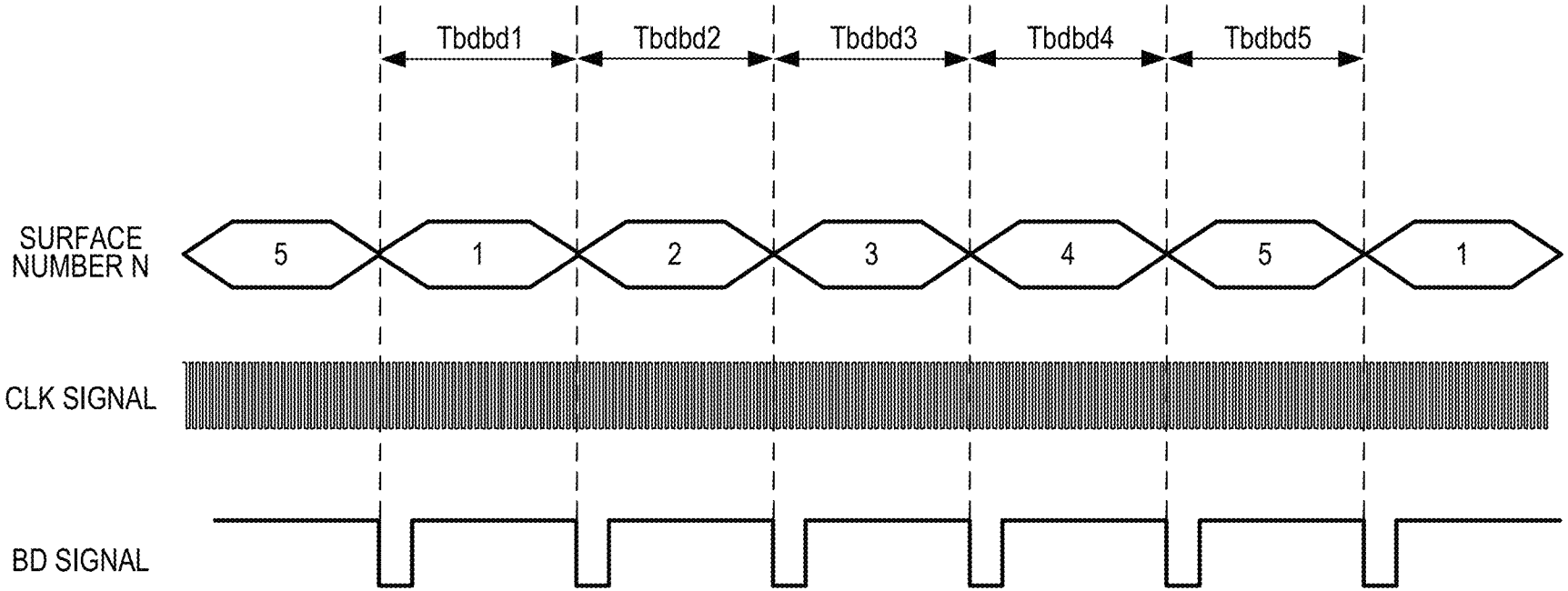
FIG. 8 is a time chart for illustrating measurement of the BD signal intervals, which is executed by the CPU of the first embodiment.

With reference to FIG. 8, a description will be provided of a relationship among the surface numbers N, the CLK signals, the BD signals, and the BD signal intervals Tbdbd for measurement of the BD signal interval Tbdbd. FIG. 8 is a time chart for illustrating the measurement of the BD signal intervals Tbdbd, which is executed by the CPU 303 of the first embodiment. First, at a timing at which the surface number N becomes 1, the BD signal interval Tbdbd1 as a time interval of the BD signals is measured based on the CLK signals. Similarly, at timings at which the surface number N becomes 2, 3, 4, and 5, the BD signal intervals Tbdbd2, Tbdbd3, Tbdbd4, and Tbdbd5 are measured based on the CLK signals each time the BD signals are input.

(Calculation of Correction Amounts)

In the embodiment, in order to correct a deviation of writing start position of an electrostatic latent image for each reflection surface of the rotary polygon mirror 204, the emitting start timing of the light beam is corrected for each reflection surface based on a measurement result of the BD signal intervals Tbdbd. Now, a detailed description will be provided of the processing of Step S106 and Step S107 of FIG. 3. With the processing of Step S106 and Step S107, a correction amount for correction of the emitting start timing of the light beam for each reflection surface of the rotary polygon mirror 204 is determined.

The BD signal intervals at the normal temperature, which are measured in association with the reference surface numbers Nref during the adjustment step in a factory, are stored in the memory 306 as reference BD signal intervals (reference data) Tref in association with the reference surface numbers Nref as shown in Table 1.

TABLE 1

| Reference Surface Number Nref | Reference BD Signal Interval Tref |
|---|---|
| 1 | Tref 1 |
| 2 | Tref 2 |
| 3 | Tref 3 |
| 4 | Tref 4 |
| 5 | Tref 5 |

In Step S106, the CPU 303 reads the reference BD signal intervals (reference data) Tref (Tref1, Tref2, Tref3, Tref4, and Tref5) stored in the memory 306 during the adjustment step in a factory. In the embodiment, the reference BD signal intervals Tref are reference data which are measured at the normal temperature during the adjustment step in a factory.

In Step S107, the CPU 303 calculates positional deviation amounts ΔT1 to ΔT4 per unit time based on the reference BD signal intervals Tref1 to Tref4 and the BD signal intervals Tbdbd1 to Tbdbd4 measured in Step S105.

Positional deviation Amount ΔT1 between Reference Surface Number 1 and Reference Surface Number 2=Tref1−Tbdbd1 — Expression 1

Positional deviation Amount ΔT2 between Reference Surface Number 2 and Reference Surface Number 3=Tref2−Tbdbd2 — Expression 2

Positional deviation Amount ΔT3 between Reference Surface Number 3 and Reference Surface Number 4=Tref3−Tbdbd3 — Expression 3

Positional deviation Amount ΔT4 between Reference Surface Number 4 and Reference Surface Number 5=Tref4−Tbdbd4 — Expression 4

It is not necessary to use the positional deviation amount ΔT5 for calculation of the correction amount. Thus, calculation by the CPU 303 is not performed. The CPU 303 functions as a positional deviation amount calculation unit which is configured to calculate the positional deviation amounts ΔT1 to ΔT4 of the writing start positions per unit time based on the reference BD signal intervals (reference pulse intervals) Tref1to Tref4 and the BD signal intervals (pulse intervals) Tbdbd1 to Tbdbd4.

Further, when the reference surface number 1 is set as a reference position (control target position), respective correction amounts (correction times) Tofset of the reference surface numbers Nref are expressed by the following expressions.

Correction Amount Tofset1 for Reference Surface Number 1=0 — Expression 5

Correction Amount Tofset2 for Reference Surface Number 2=ΔT1 — Expression 6

Correction Amount Tofset3 for Reference Surface Number 3=ΔT1+ΔT2 — Expression 7

Correction Amount Tofset4 for Reference Surface Number 4=ΔT1+ΔT2+ΔT3 — Expression 8

Correction Amount Tofset5 for Reference Surface Number 5=ΔT1+ΔT2+ΔT3+ΔT4 — Expression 9

The CPU 303 stores the calculated correction amounts Tofset1, Tofset2, Tofset3, Tofset4, and Tofset5 in the RAM 307. The CPU 303 functions as a correction amount calculation unit which is configured to calculate respective correction amounts Tofset for the reference surface numbers Nref based on the reference BD signal intervals (reference pulse intervals) Tref1 to Tref4 and the BD signal intervals (pulse intervals) Tbdbd1 to Tbdbd4.

Figure 9:
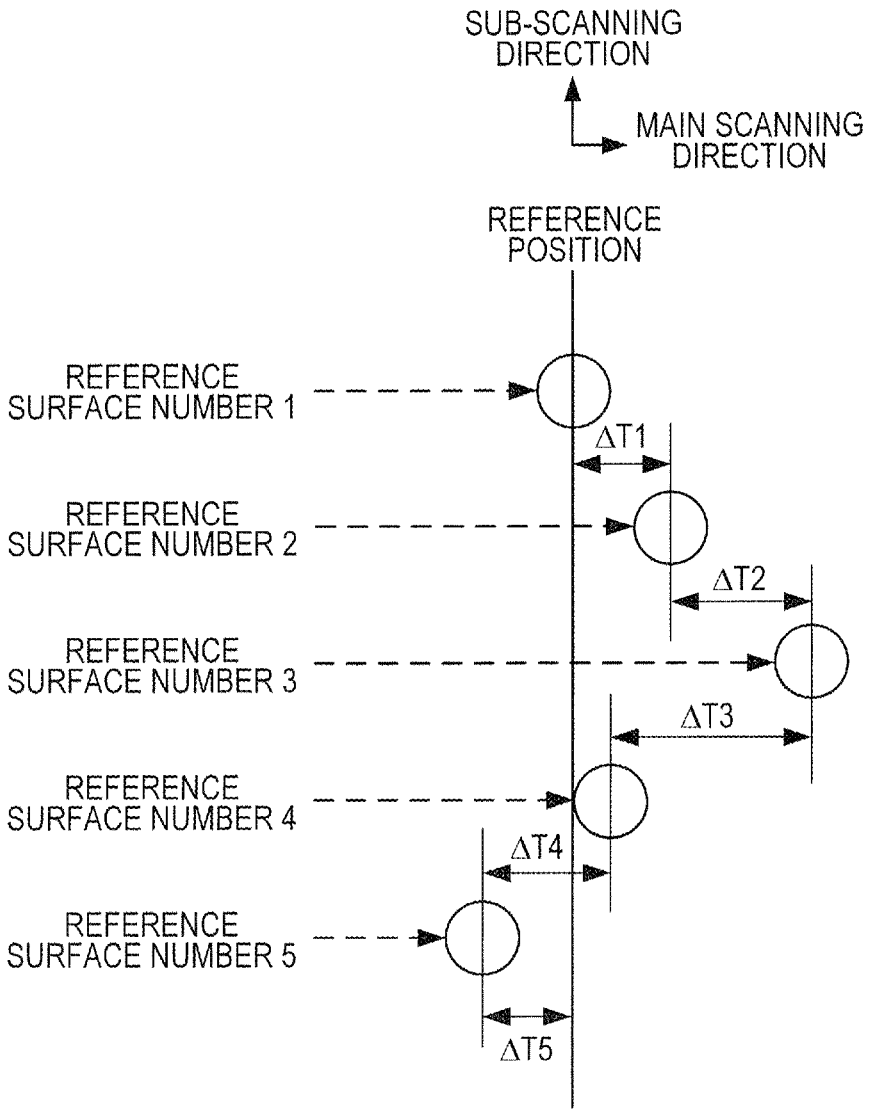
FIG. 9 is a diagram for illustrating positional deviation amounts of electrostatic latent images for reference surface numbers with respect to a reference position.

With reference to FIG. 9, a description will be provided of positional deviation amounts ΔT for the reflection surfaces for electrostatic latent images formed on the image forming area (exposure surface) of the surface of the photosensitive drum 102. FIG. 9 is a diagram for illustrating positional deviation amounts ΔT (ΔT1, ΔT2, ΔT3, ΔT4, and ΔT5) of the electrostatic latent images for the reference surface numbers Nref with respect to the reference position. In accordance with the amounts of fluctuation in BD signal intervals Tbdbd due to the temperature rise in the image forming apparatus 100, positional deviations of the electrostatic latent images in the main scanning direction occur. The amounts of fluctuation in BD signal intervals Tbdbd are calculated based on the reference BD signal intervals Tref stored in the memory 306 and the measured BD signal intervals Tbdbd. In the embodiment, the correction amounts Tofset are calculated for the reference surface numbers Nref based on the reference BD signal intervals Tref and the BD signal intervals Tbdbd. Thus, the amount of fluctuation in BD signal interval Tbdbd can be corrected for each reference surface number Nref based on the correction amount Tofset. The CPU 303 functions as a light source control unit which is configured to control the light source 201 to correct the positional deviation amount ΔT of the writing start position of the electrostatic latent image for each reference surface number Nref based on the correction amount Tofset.

(Correction of Emitting Start Timings of Light Beam)

In the embodiment, in order to correct the deviation of writing start position of the electrostatic latent image for each reflection surface of the rotary polygon mirror 204, the emitting start timing (writing start position) of the light beam is corrected for each reference surface number Nref based on the correction amount Tofset.

Figure 10:
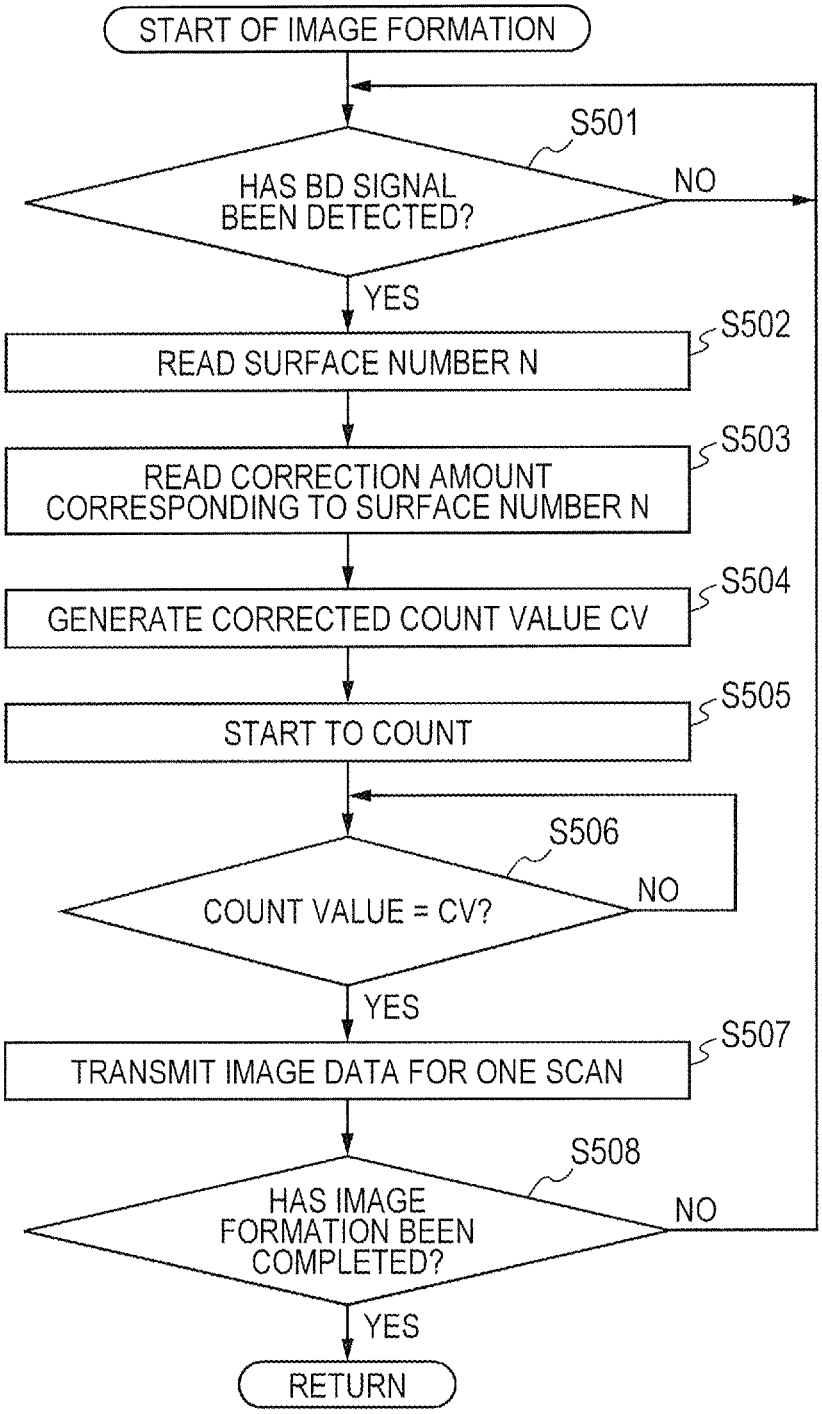
FIG. 10 is a flowchart for illustrating a control operation for image formation, which is executed by the CPU of the first embodiment.

Now, with reference to FIG. 10, a description will be provided of correction of the emitting start timings of the light beam of the rotary polygon mirror 204, which is executed by the CPU 303. FIG. 10 is a flowchart for illustrating a control operation for image formation which is executed by the CPU 303 of the first embodiment. The CPU 303 executes the image formation based on the program stored in the ROM 308.

The control operation for the image formation illustrated in FIG. 10 is executed (Step S108 of FIG. 3) after the calculation of the correction amounts (Step S101 to Step S107) illustrated in FIG. 3. When the control operation for the image formation is started, the CPU 303 determines whether or not the BD signal has been detected (Step S501). When the BD signal has not been detected (NO in Step S501), the CPU 303 returns the processing to Step S501. When the BD signal has been detected (YES in Step S501), the CPU 303 reads the surface number N stored in the RAM 307 (Step S502). The surface number N of the reflection surface of the rotary polygon mirror 204 is updated by the CPU 303 each time the BD signal is input as described above. The CPU 303 reads the correction amount Tofset corresponding to the surface number N from the RAM 307 (Step S503). At this time, the correspondence relation between the surface numbers N and the reference surface numbers Nref has already been identified, and hence the CPU 303 can read, from the RAM 307, the correction amount Tofset corresponding to the surface number N currently deflecting the light beam.

Before the image formation, the CPU 303 reads, from the memory 306 of the light scanning apparatus 104, the emitting start timing reference data RT (RT1, RT2, RT3, RT4, and RT5) corresponding to the reference surface numbers Nref (Step S106 of FIG. 3). The CPU 303 corrects the emitting start timing reference data RT corresponding to the reference surface numbers Nref identified by the surface numbers N based on the correction amounts Tofset and generates a corrected count value CV (Step S504). For example, the corrected count value CV can be calculated with the following expression.

$$CV=RT+Tofset$$

The CPU 303 stores the generated corrected count value CV in the RAM 307.

The CPU 303 starts counting in accordance with the CLK signals (clock) input from the clock generator 310 (Step S505). The CPU 303 determines whether or not the count value matches with the corrected count value CV (Step S506). When the count value does not match with the corrected count value CV (NO in Step S506), the CPU 303 returns the processing to Step S506. When the count value matches with the corrected count value CV (YES in Step S506), the CPU 303 transmits image data for one scanning in the main scanning direction to the light source drive circuit 304 (Step S507). The image data is transmitted in a sequential manner one pixel after another to the light source drive circuit 304 from the image data corresponding to a scanning start position at time intervals corresponding to printing time for each pixel. The light source drive circuit 304 controls the light source 201 in accordance with the image data to emit the light beam from the light source 201. The emitting start timing of the light beam emitted from the light source 201 is corrected in accordance with the transmission start timing of the image data from the CPU 303 to the light source drive circuit 304. The CPU 303 determines whether or not the image formation has been completed (Step S508). When the image formation has not been completed (NO in Step S508), the CPU 303 returns the processing to Step S501. The CPU 303 repeats the processing from Step S501 to Step S507 to perform image formation of next scanning. When the image formation has been completed (YES in Step S508), the CPU 303 completes the control operation for the image formation.

Figure 11:
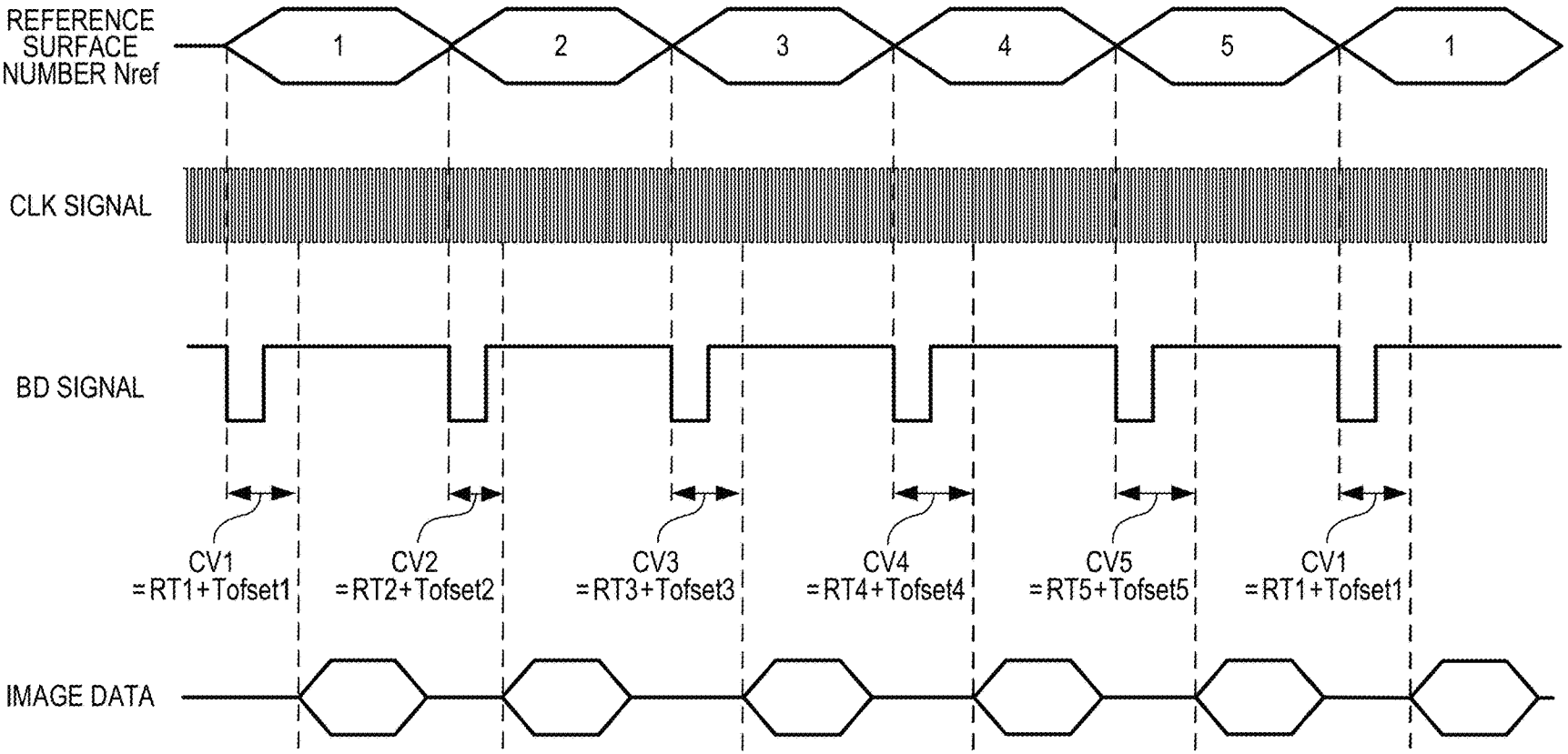
FIG. 11 is a time chart of the control operation for image formation, which is executed by the CPU of the first embodiment.

FIG. 11 is a time chart for illustrating the control operation for the image formation, which is executed by the CPU 303 of the first embodiment. With reference to FIG. 11, a description will be provided of correction of emitting start timings of the light beam by the rotary polygon mirror 204, which is executed by the CPU 303. FIG. 11 is an illustration of the reference surface numbers Nref, the CLK signals, the BD signals, the image data, and the corrected count values CV for the image formation. For scanning with the light beam by the reflection surface of the surface number N, the CPU 303 starts counting in synchronization with the BD signals. When the count value becomes the corrected count value CV corresponding to the reference surface number Nref identified by the surface number N, transmission of image data is started. With this, the emitting start timing of the light beam is corrected for each reflection surface of the rotary polygon mirror 204 being rotated. Thus, the deviation of writing start position of the electrostatic latent image can be corrected for each reflection surface of the rotary polygon mirror 204.

According to the embodiment, the positional deviation of the image for each reflection surface of the rotary polygon mirror 204, which is caused by changes in ambient temperature of the image forming apparatus 100 or temperature rise in the image forming apparatus 100, can be corrected. Thus, occurrence of uneven image density due to the positional deviation of the image is prevented, thereby being capable of forming a high quality image.

According to the embodiment, the uneven density in the image which is caused by the deviation of writing start position of the electrostatic latent image for each reflection surface can be corrected based on the BD signals (detected signals) of the BD (beam detector) 207. The emitting start timing of the light beam is corrected for each reflection surface of the rotary polygon mirror 204 based on the BD signal intervals of the BD signal output from the BD 207, thereby being capable of preventing occurrence of the uneven image density even when the position of the BD 207 is shifted due to the temperature rise.

According to the embodiment, the uneven image density which is caused by the deviation of writing start position of the electrostatic latent image for each reflection surface can be corrected based on the detected signals of the beam detector.

[Second Embodiment]

Now, a second embodiment will be described. In the second embodiment, the structures which are the same as those of the first embodiment are denoted by the same reference symbols, and description thereof is omitted. In the first embodiment, in order to correct a deviation of writing start position of the electrostatic latent image for each reflection surface of the rotary polygon mirror 204, the emitting start timing is corrected for each reflection surface based on the correction amount Tofset. In the second embodiment, in order to correct the deviation of writing start position of the electrostatic latent image for each reflection surface of the rotary polygon mirror 204, image data is corrected based on the correction amount Tofset. Through filter operation processing for image data, occurrence of banding (band-like uneven image density) in the image is prevented. Description is hereinafter made mainly of portions which are different from the first embodiment.

The image forming apparatus 100, the light scanning apparatus 104, and the control system 300 of the second embodiment have the same structures as those of the first embodiment. Thus, the same reference symbols are given, and description thereof is omitted. In the second embodiment, before the image formation, the CPU 303 calculates correction shift amounts (correction information in the main scanning direction) CS in pixel units based on the correction amounts Tofset. The CPU 303 corrects the image data based on the correction shift amounts CS during the image formation to prevent occurrence of banding in the image. Description is hereinafter made of the correction processing for image data.

<Calculation of Correction Shift Amounts>

Figure 12:
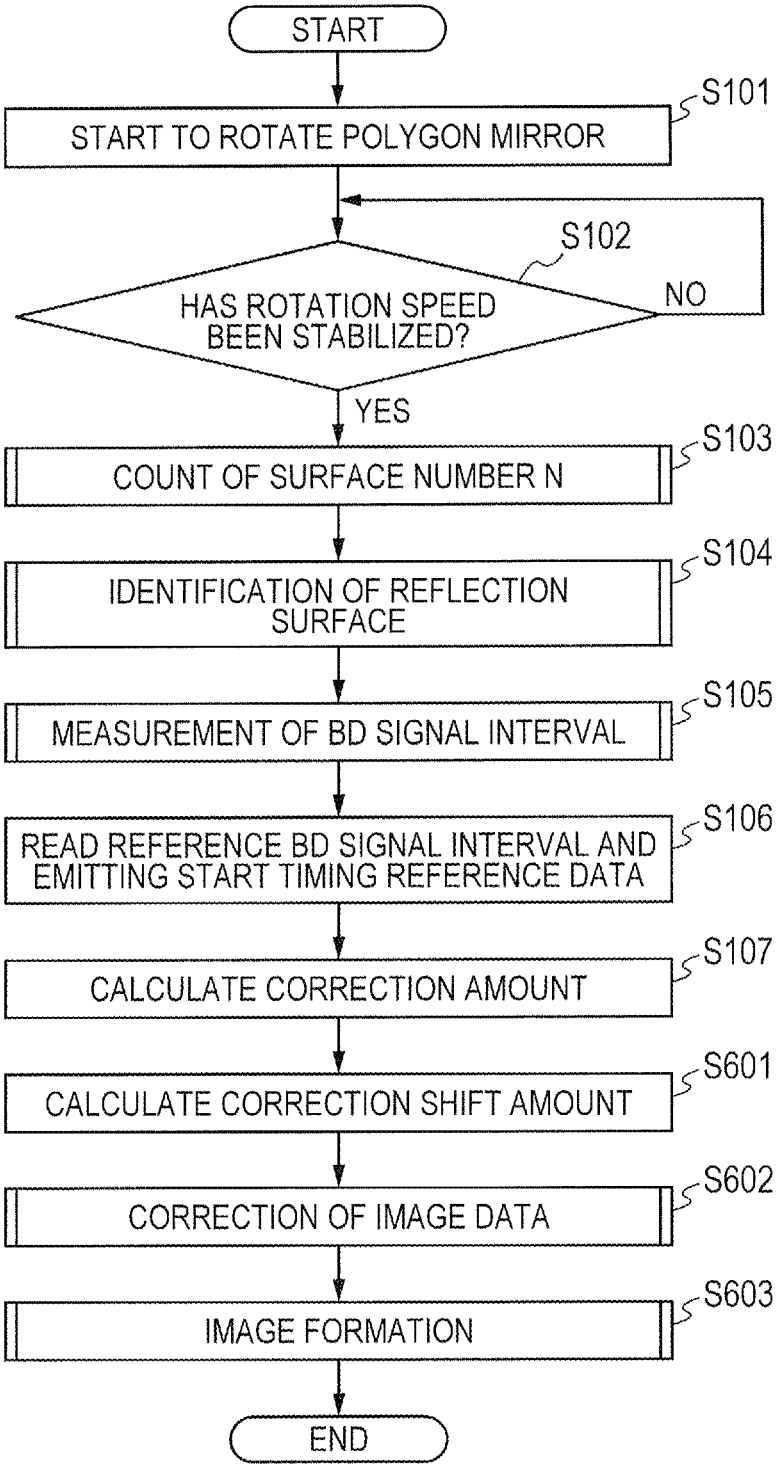
FIG. 12 is a flowchart for illustrating correction processing for image data, which is executed by a CPU of a second embodiment.

FIG. 12 is a flowchart for illustrating correction processing for image data, which is executed by the CPU 303 of the second embodiment. The CPU 303 executes the correction processing for image data based on the program stored in the ROM 308. Step S101 to Step S107 of FIG. 12 are the same as Step S101 to Step S107 of the first embodiment illustrated in FIG. 3. Thus, description thereof is omitted. Based on the correction amounts Tofset for the reference surface numbers Nref calculated in Step S107, the CPU 303 calculates the correction shift amounts CS as correction values in pixel units for correction of the positional deviation amounts in the main scanning direction for the reference surface numbers Nref (Step S601). Based on the correction amounts Tofset1 to Tofset5 calculated with Expression 5 to Expression 9 for the reference surface numbers Nref, correction shift amounts CS1 to CS5 in pixel units for the reference surface numbers Nref are calculated with following Expression 10.

$$CS = Tofset \times V/(25400/1200) \qquad \text{Expression 10}$$

In the embodiment, a pixel resolution is 1,200 dpi. A unit for the correction amount Tofset is a second. A unit for a scanning speed V of the light beam which scans on the photosensitive drum 102 in the main scanning direction is pm/second. However, the present invention is not limited to those values, and those values are suitably set as needed.

The CPU 303 stores, in the RAM 307, the correction shift amounts CS1 to CS5 in pixel units which are calculated for the reference surface numbers 1 to 5. The CPU 303 executes correction of image data with use of the correction shift amounts CS (Step S602). The CPU 303 executes the image formation with use of the corrected image data (Step S603). In the second embodiment, the image data is corrected with use of the correction shift amounts CS, thereby preventing banding caused by the positional deviation in each reflection surface. The correction of the image data with use of the correction shift amounts CS will be described later.

In the embodiment, the image data is corrected with use of the correction shift amounts CS before the image formation. However, the present invention is not necessarily limited to this. The correction shift amounts may be calculated to correct image data during the image formation. In that case, for example, the processing from Step S103 to Step S602 of FIG. 12 may be executed in parallel with the image formation in Step S603 of FIG. 12. The internal temperature of the image forming apparatus 100 rises as the number of sheets subjected to the image formation increases. Thus, it is effective to calculate the correction shift amounts CS during the image formation and correct the image data. Further, when images are formed successively on a plurality of recording media S, the correction shift amounts CS may be calculated between the recording media S, that is, between sheets to correct image data.

(Correction of Image Data)

Figure 13:
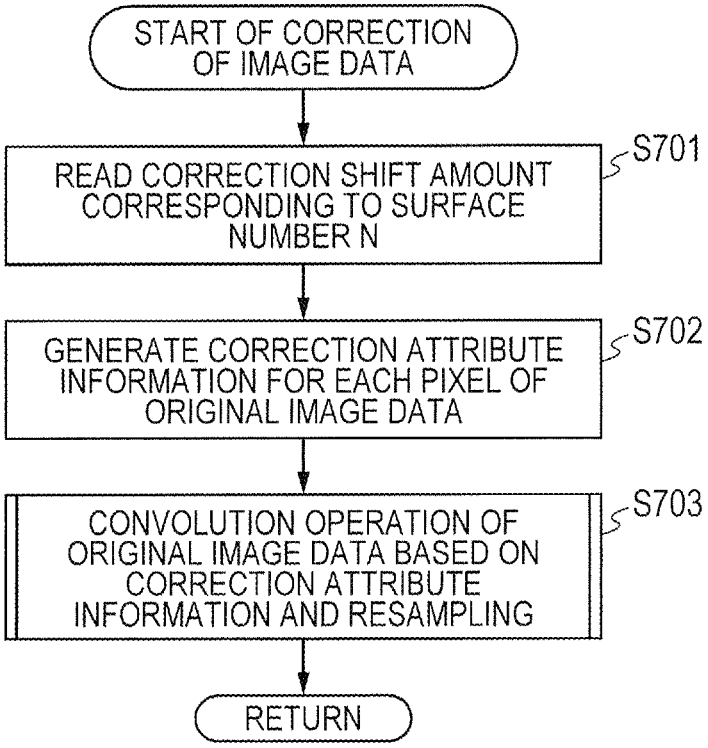
FIG. 13 is a flowchart for illustrating correction of image data, which is executed by the CPU of the second embodiment.

In the embodiment, in order to prevent banding caused by the deviation of writing start position of the electrostatic latent image for each reflection surface of the rotary polygon mirror 204, correction of image data for each reference surface number Nref is performed based on the correction shift amount CS during the image formation. Next, a more detailed description will be provided of the correction of image data in Step S602 of FIG. 12. In the embodiment, in order to prevent occurrence of banding caused by the deviation of writing start position of the electrostatic latent image due to changes in temperature, the CPU 303 corrects a gravity center position of the image data. FIG. 13 is a flowchart for illustrating correction of image data, which is executed by the CPU 303 of the second embodiment. The CPU 303 executes correction of image data based on the program stored in the ROM 308.

When the correction processing for image data is started, the CPU 303 reads the correction shift amount CS corresponding to the surface number N from the RAM 307 (Step S701). In the embodiment, the correction shift amount CS is correction information representing a correction value in pixel units for correction of a positional deviation amount (hereinafter referred to as "shifted amount") ΔS in pixel units for a writing start position of the electrostatic latent image in the main scanning direction to an ideal position.

Figure 14B:
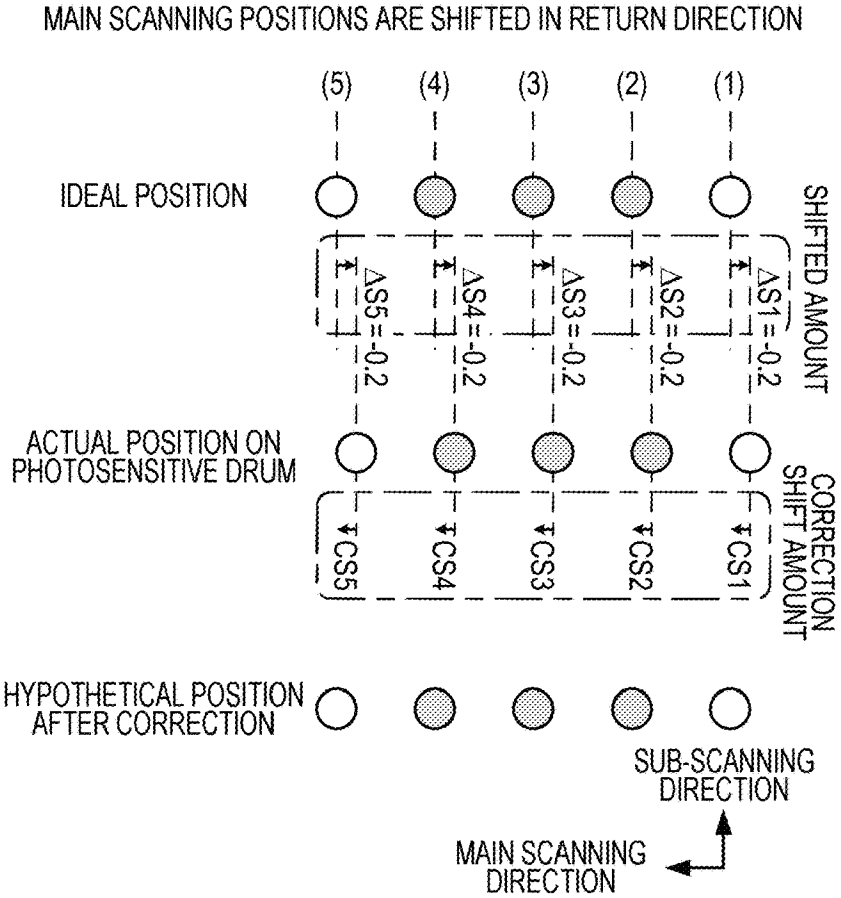
FIG. 14A and FIG. 14B are explanatory views for illustrating shifted amounts and correction shift amounts of electrostatic latent images in a main scanning direction.
Figure 14A:
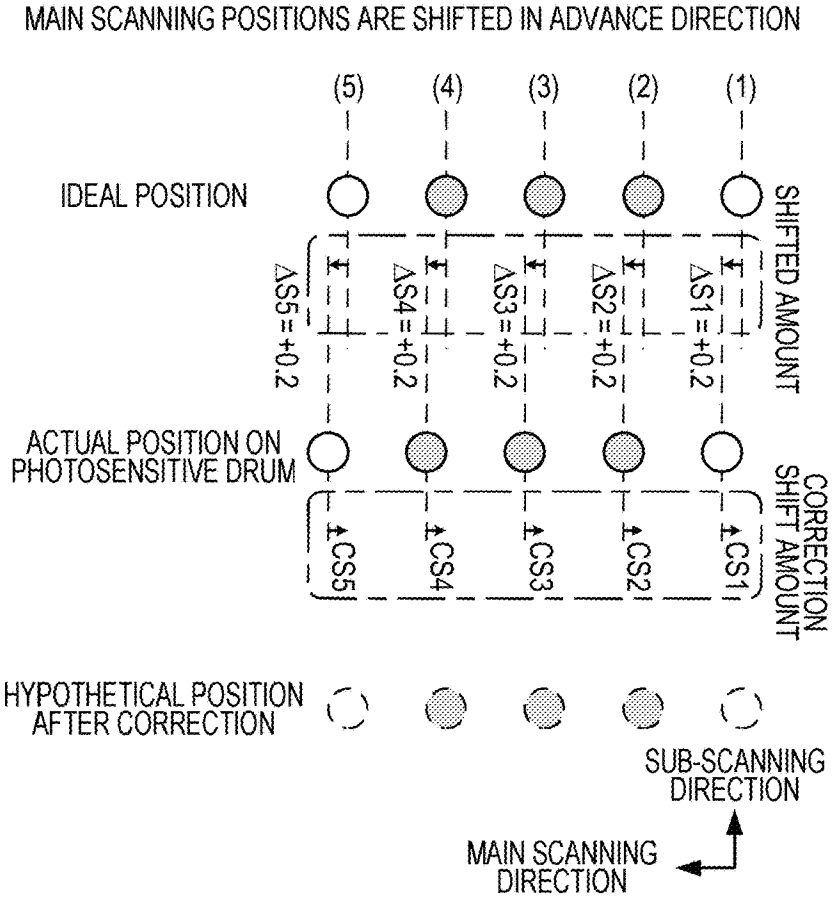

The state of the deviation of writing start position of the electrostatic latent image in the main scanning direction can be classified into two cases including (a) a case of having been shifted in an advance direction and (b) a case of having been shifted in a return direction. FIG. 14A and FIG. 14B are explanatory diagrams for illustrating shifted amounts ΔS and correction shift amounts CS in the main scanning direction of the electrostatic latent image. In FIG. 14A and FIG. 14B, circles represent pixels arrayed in the main scanning direction. The shading of the circle represents density. The dotted lines represent positions of pixels in the main scanning direction. The pixel numbers (1) to (5) indicate the order of the pixels. Further, in each of FIG. 14A and FIG. 14B, there are illustrated the upper row of pixels representing ideal positions, the center row of pixels representing actual positions on the photosensitive drum 102, and the lower row of pixels representing hypothetical positions after correction. The shifted amounts ΔS1 to ΔS5 respectively corresponding to the pixel numbers (1) to (5) represent positional deviation amounts of pixels from ideal positions to actual positions. The correction shift amounts CS1 to CS5 respectively corresponding to the pixel numbers (1) to (5) represent correction amounts of pixels from the actual positions to the ideal positions. Units of the shifted amount ΔS and the correction shift amount CS are pixels which are given when the interval of the ideal pixel positions is one pixel, and the advance direction of the main scanning direction has a positive value.

FIG. 14A is an illustration of a state in which the actual positions of the pixels of the electrostatic latent image on the photosensitive drum 102 are shifted with respect to the ideal positions in the advance direction of the main scanning direction, and in which the shifted amount ΔS is +0.2 pixel. FIG. 14B is an illustration of a state in which the actual positions of the pixels of the electrostatic latent image on the photosensitive drum 102 are shifted with respect to the ideal positions in the return direction of the main scanning direction, and in which the shifted amount ΔS is −0.2 pixel.

(Coordinate Transformation)

Referring back to FIG. 13, the CPU 303 next generates correction attribute information for each pixel of original image data (Step S702). In the embodiment, in order to perform correction of the shifted amount ΔS (coordinate transformation) and correction of density (filter processing), the coordinate transformation in the main scanning direction is applied to the original image data, and thereafter interpolation and sampling are performed for correction. In the embodiment, first, the coordinate transformation is performed while storing density (pixel value) of the original image data.

Figure 15A:
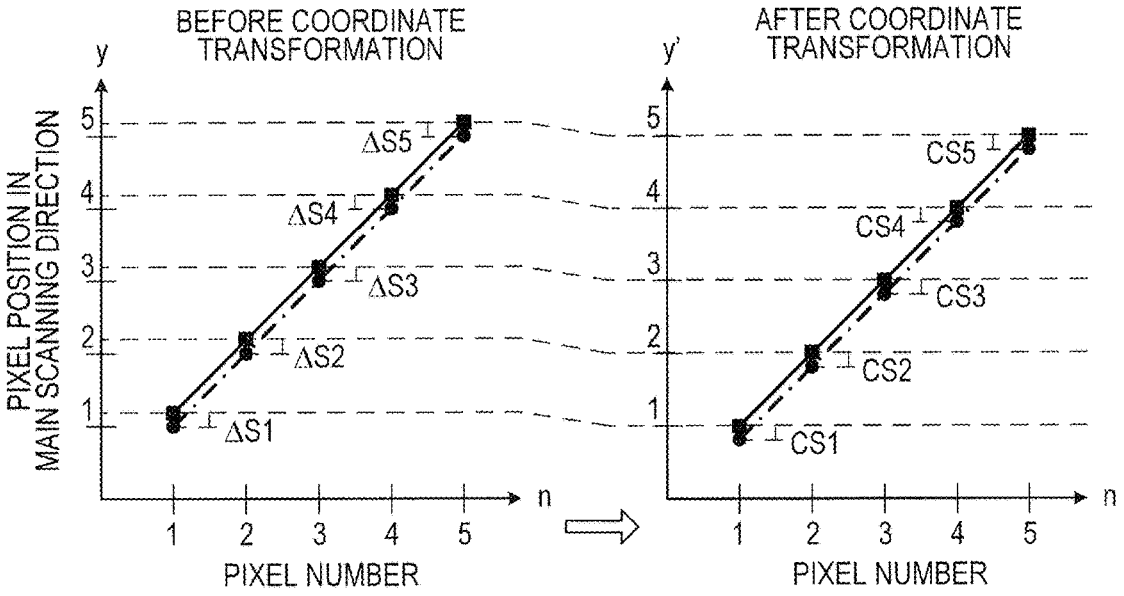
FIG. 15A and FIG. 15B are explanatory graphs for showing coordinate transformation of image data.
Figure 15B:
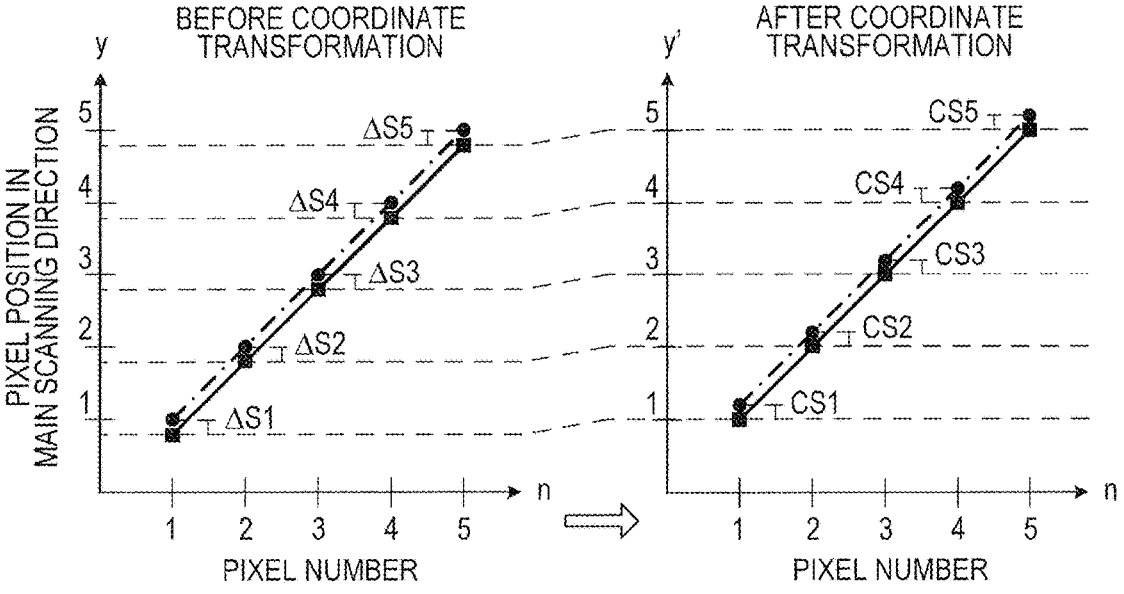

FIG. 15A and FIG. 15B are explanatory graphs for showing coordinate transformation of image data. In each of the graphs shown in FIG. 15A and FIG. 15B, the horizontal axis represents pixel numbers "n", and the vertical axis represents pixel positions "y" in the main scanning direction in pixel units. FIG. 15A is a graph for showing a state in which actual positions of pixels of the electrostatic latent image on the photosensitive drum 102 are shifted with respect to ideal positions in the advance direction of the main scanning direction. FIG. 15B is a graph for showing a state in which the actual positions of the pixels of the electrostatic latent image on the photosensitive drum 102 are shifted with respect to the ideal positions in the return direction of the main scanning direction. FIG. 15A and FIG. 15B correspond to FIG. 14A and FIG. 14B, respectively. The plotted rectangular dots indicate the actual positions (scanning line positions) of the pixels of the electrostatic latent image on the photosensitive drum 102. The plotted circular dots indicate the ideal positions, that is, positions at which pixels are desirably expressed. In each of FIG. 15A and FIG. 15B, the graph on the left side represents positions of pixels before the coordinate transformation, and the graph on the right side represents positions of pixels after the coordinate transformation.

In the graph representing the state before the coordinate transformation illustrated on the left side of FIG. 15A, the linear function plotted with the circular dots indicating the ideal positions has a straight line which represents that the pixel numbers "n" and the pixel positions "y" in the main scanning direction have an equal inclination of 1 and an intercept at 0, and is expressed by following Expression 11.

$$y=n \qquad \text{Expression 11}$$

In contrast, while the linear function plotted with the rectangular dots indicating the actual positions have an inclination of 1, the actual positions are shifted by ΔS (=+0.2) in the advance direction of the main scanning direction. Thus, the linear function represents a straight line with an intercept of ΔS, and is expressed by following Expression 12.

$$y=n+\Delta S \qquad \text{Expression 12}$$

In the embodiment, the coordinate transformation is performed to replace the actual positions with the ideal positions. In the example shown in FIG. 15A, the coordinate transformation is performed with following Expression 13.

$$y'=y+\mathrm{CS} \qquad \text{Expression 13}$$

The correction shift amount CS and the shifted amount ΔS have a relationship as expressed by following Expression 14.

$$\mathrm{CS}=-\Delta S \qquad \text{Expression 14}$$

With Expression 13 for the coordinate transformation and Expression 14 for calculation of the correction shift amount CS, Expression 11 and Expression 12 are converted to following Expression 15 and Expression 16, respectively.

$$y'=n-\Delta S \qquad \text{Expression 15}$$

$$y'=n \qquad \text{Expression 16}$$

Expression 15 represents the straight line of the ideal positions indicated by the circular dots after the coordinate transformation as shown in the graph on the right side of FIG. 15A. Expression 16 represents the straight line of the actual positions indicated by the rectangular dots after the coordinate transformation as shown in the graph on the right side of FIG. 15A.

Also in the graph of FIG. 15B for showing the case where the actual positions are shifted by ΔS (=−0.2) in the return direction of the main scanning direction, when ΔS=−0.2 is given, the above-mentioned Expression 11 to Expression 16 are similarly satisfied. Thus, description thereof is omitted.

In the embodiment, Expression 12 representing the actual positions, Expression 13 representing the coordinate transformation, and Expression 14 for calculation of the correction shift amount CS are changed for each pixel number "n" into following Expression 17, Expression 18, and Expression 19 to perform the coordinate transformation.

$$y=n+\Delta Sn \qquad \text{Expression 17}$$

$$y'=y+\mathrm{CS}n \qquad \text{Expression 18}$$

$$\mathrm{CS}n=-\Delta Sn \qquad \text{Expression 19}$$

The CPU 303 stores, in the RAM 307, the pixel positions of original image data having been subjected to the coordinate transformation with use of Expression 17, Expression 18, and Expression 19 and pixel positions on the photosensitive drum as correction attribute information.

(Filter Processing)

Figure 16A:
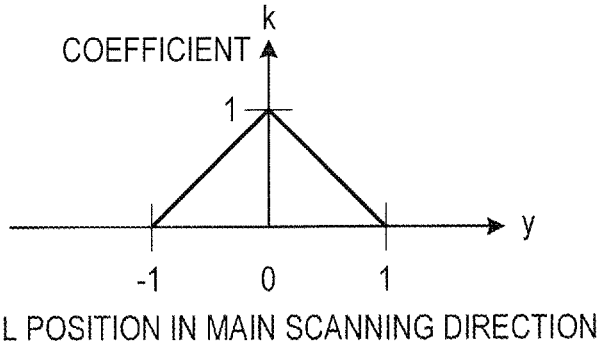
FIG. 16A, FIG. 16B, and FIG. 16C are graphs for showing convolution functions for use in filter processing.
Figure 16B:
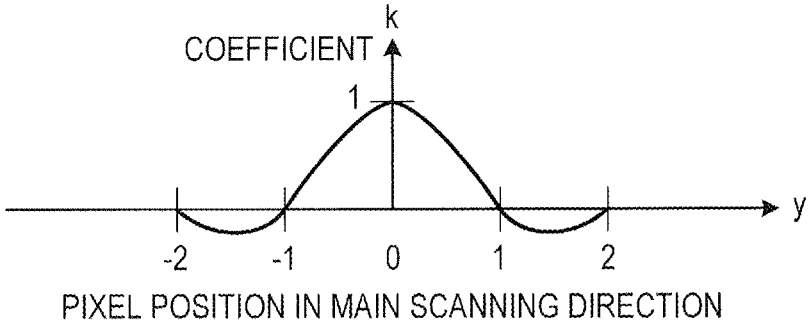
Figure 16C:
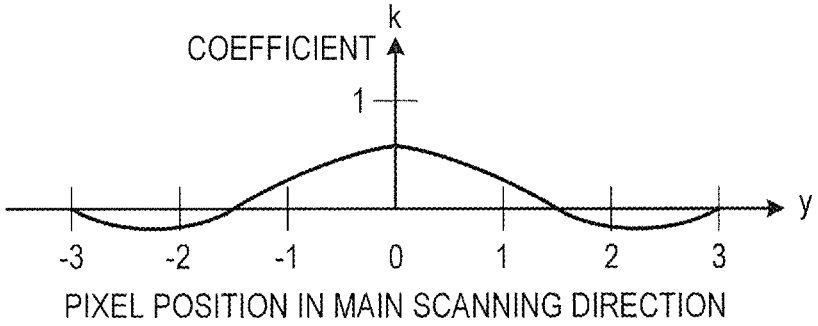

Referring back to FIG. 13, next, the CPU 303 performs the convolution operation of original data based on the correction attribute information and resampling (Step S703). In order to generate corrected image data, filter processing is performed with use of the convolution function with respect to original image data after the coordinate transformation. However, a coefficient for the filter processing is calculated from the convolution function based on a distance between a position of original image data reflecting the correction shift amount CS and a sampling position. FIG. 16A, FIG. 16B, and FIG. 16C are graphs for showing the convolution function for use in the filter processing. FIG. 16A represents a linear interpolation. FIG. 16B and FIG. 16C represent bicubic interpolation. The convolution function of the embodiment can be selected from the linear interpolation and the bicubic interpolation shown in FIG. 16A, FIG. 16B, and FIG. 16C. In FIG. 16A, FIG. 16B, and FIG. 16C, the y-axis represents pixel positions in the main scanning direction in pixel units, and the k-axis represents a magnitude of the coefficient. When the spread of the convolution function is denoted by L, a function value of equal to or larger than +L and equal to or smaller than −L is defined as a minimum value of 0. The spread L of the convolution function in the linear interpolation of FIG. 16A is 1 (L=1). The spread L of the convolution function in the bicubic interpolation of FIG. 16B is 2 (L=2). The spread L of the convolution function in the bicubic interpolation of FIG. 16C is 3 (L=3). Further, in accordance with the spread L of the convolution function, the sample pixel number of the original image is 2L+1 in the embodiment. The convolution function, the coefficient "k", and the spread L are stored in the ROM 308.

The linear interpolation shown in FIG. 16A is expressed by following Expression 20.

$$k=y+1 \ (-1\le y\le 0)$$

$$k=-y+1 \ (0<y\le 1)$$

$$0 \ (y<-1,\ y>1) \qquad \text{Expression 20}$$

The bicubic interpolation shown in FIG. 16B and FIG. 16C is expressed by following Expression 21 and Expression 22.

$$\text{bicubic}(t)=\begin{cases}(a+2)|t|^3-(a+3)|t|^2+1 & (|t|\le 1)\\ a|t|^3-5a|t|^2+8a|t|-4a & (1<|t|\le 2)\\ 0 & (2<|t|)\end{cases} \qquad \text{Expression 21}$$

$$k=\text{bicubic}\left(\frac{y}{w}\right)\Big/w \qquad \text{Expression 22}$$

In the embodiment, "a" of Expression 21 is −1 (a=−1). In the bicubic interpolation shown in FIG. 16B, "w" of Expression 22 is 1 (w=1). In the bicubic interpolation shown in FIG. 16C, "w" of Expression 22 is 1.5 (w=1.5). The "a" and/or "w" may be adjusted in accordance with electrophotographic characteristics.

Figure 17A:
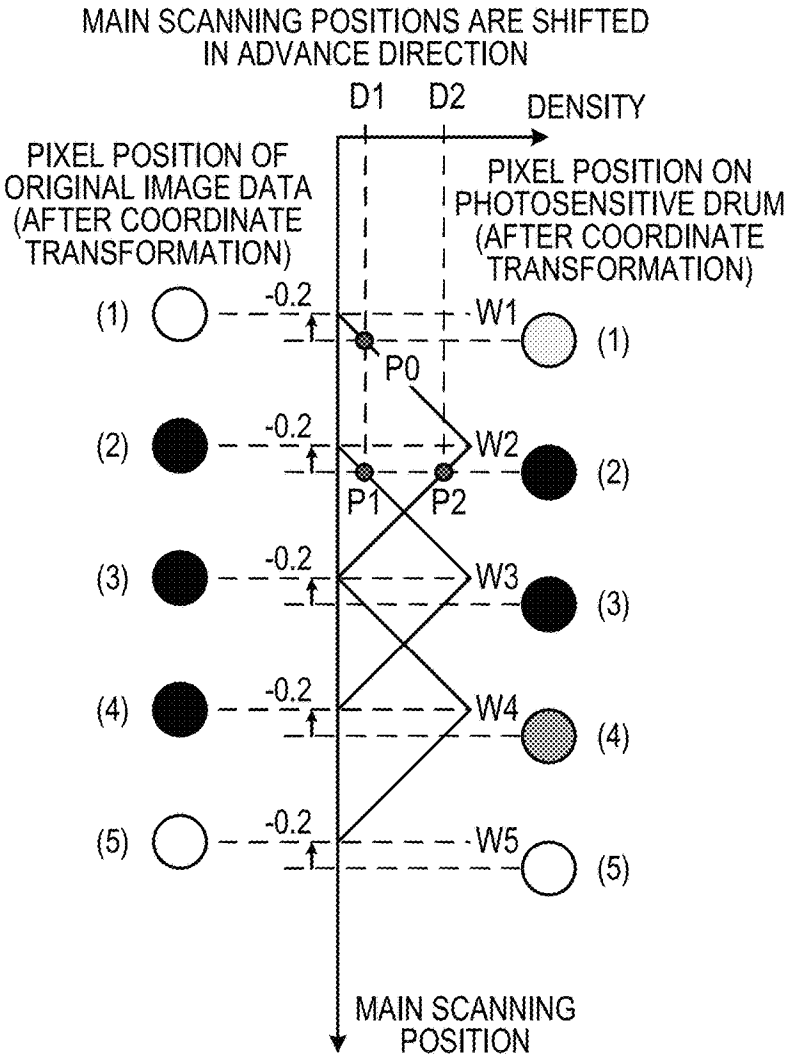
FIG. 17A and FIG. 17B are explanatory diagrams of filter processing with use of linear interpolation.
Figure 17B:
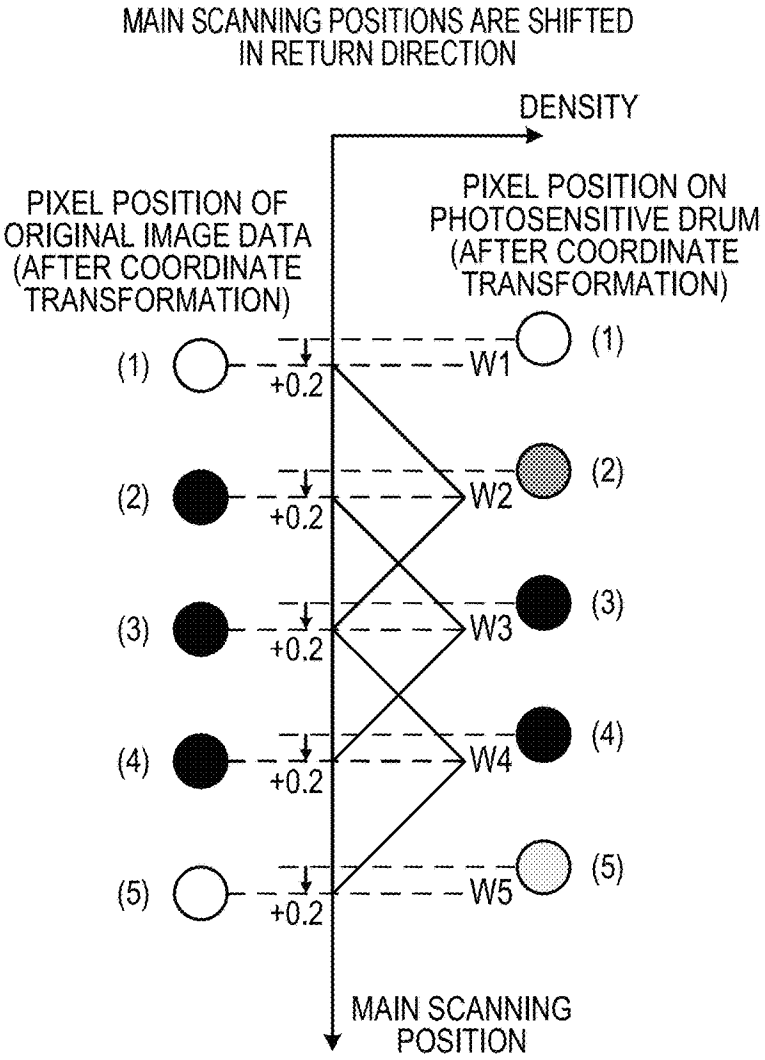

With reference to FIG. 17A and FIG. 17B, a description will be provided of a specific example of performing the filter processing with use of the convolution function of Expression 20 based on pixel positions after the coordinate transformation in the embodiment. FIG. 17A and FIG. 17B are explanatory diagrams of the filter processing with use of the linear interpolation. FIG. 17A is an illustration of a state in which actual positions of the pixels of the electrostatic latent image on the photosensitive drum 102 are shifted with respect to the ideal positions in the advance direction of the main scanning direction. FIG. 17B is an illustration of a state in which the actual positions of the pixels of the electrostatic latent image on the photosensitive drum 102 are shifted with respect to the ideal positions in the return direction of the main scanning direction. FIG. 17A and FIG. 17B correspond to FIG. 14A and FIG. 14B, respectively. The pixel row on the left side in each of FIG. 17A and FIG. 17B represents pixel positions of original image data after the coordinate transformation. The pixel row on the right side represents the pixel positions on the photosensitive drum 102 after the coordinate transformation. Further, the magnitudes of the pixel values are illustrated with darkness of the circles. The numbers with parenthesis are scanning numbers, which are the same as the pixel numbers of FIG. 15A and FIG. 15B. In the graph at the center, the horizontal axis represents density, and the vertical axis represents the main scanning position. The symbols W1, W2, W3, W4, and W5 represent density distribution obtained through development of the pixels (1) to (5) of the original image data by linear interpolation.

The filter processing illustrated in FIG. 17A will be described. The pixel (1) and the pixel (5) have density of 0. Thus, the pixel (1) and the pixel (5) are illustrated with waveforms having W1=0 and W5=0, respectively. The densities of the pixel (2), the pixel (3), and the pixel (4) are equal to maximum values of the waveforms of W2, W3, and W4, respectively. The result of the convolution operation is a sum of all of the waveforms (ΣWn, n=1 to 5). Thus, the pixel values corresponding to the actual positions on the photosensitive drum are a sum of densities at points intersecting all of the waveforms Wn with the actual positions of the pixels (1) to (5) in the pixel row on the right side as sampling points. For example, the pixel value (1) of the pixel (1) on the photosensitive drum intersects the waveform W2 at a point P0. Thus, the pixel value (1) is calculated as density D1. Further, the pixel (2) on the photosensitive drum intersects the waveform of W2 at a point P2 and the waveform W3 at a point P1, thus the density D1+D2 is given. In the similar manner, the densities of the pixel (3), the pixel (4), and the pixel (5) on the photosensitive drum are calculated. The result of the convolution operation is represented by darkness of the circles indicating the pixels (1) to (5) in the pixel column on the right side.

The filter processing illustrated in FIG. 17B is similar to the filter processing illustrated in FIG. 17A, and hence description thereof is omitted. The result of the convolution operation for the filter processing illustrated in FIG. 17B is indicated by darkness of the circles representing the pixels (1) to (5) of the pixel row on the right side.

In the filter processing illustrated in FIG. 17A, the actual positions of pixels on the photosensitive drum 102 are shifted in the advance direction of the main scanning direction, but the gravity center of the pixel value is shifted reversely in the return direction. Thus, the uneven image density caused by the deviation of writing start position of the electrostatic latent image for each reflection surface is corrected. In the filter processing illustrated in FIG. 17B, the actual positions of pixels on the photosensitive drum 102 are shifted in the return direction of the main scanning direction, but the gravity center of the pixel value is reversely shifted in the advance direction. Thus, the uneven image density caused by the deviation of writing start position of the electrostatic latent image for each reflection surface is corrected.

(Convolution Operation)

Figure 18:
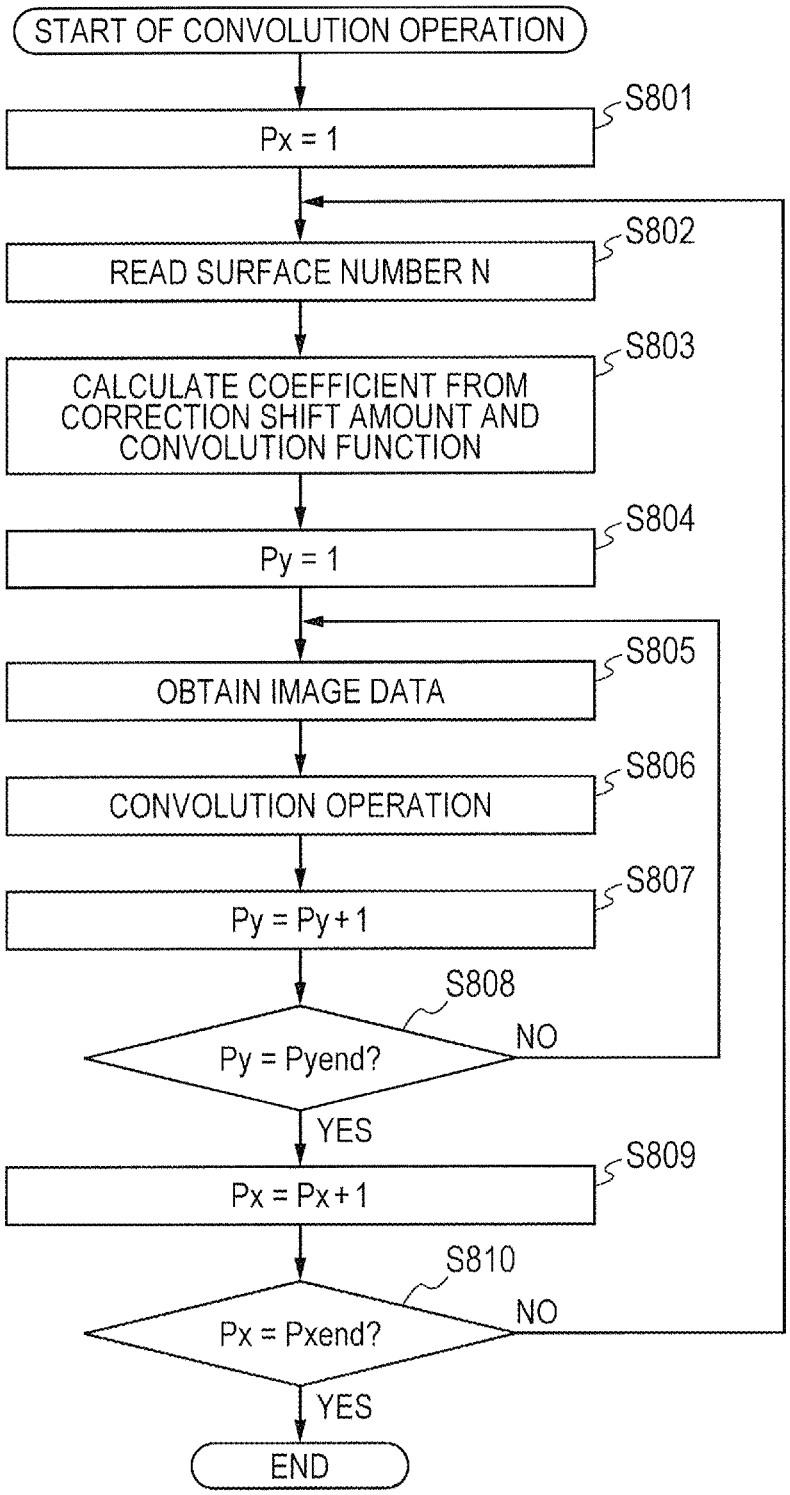
FIG. 18 is a flowchart for illustrating a convolution operation, which is executed by the CPU of the second embodiment.

Next, with reference to FIG. 18, the convolution operation in Step S703 of FIG. 13 will be described. FIG. is a flowchart for illustrating the convolution operation, which is executed by the CPU 303 of the second embodiment. The CPU 303 executes the convolution operation based on the program stored in the ROM 308.

When the convolution operation is started, the CPU 303 initializes a position Px in the sub-scanning direction (hereinafter referred to as "sub-scanning position") to 1 (Step S801). The CPU 303 reads the surface number N stored in the RAM 307 (Step S802). The surface number N of the reflection surface of the rotary polygon mirror 204 is updated by the CPU 303 each time the BD signal is input as described above. The CPU 303 calculates a coefficient of the pixel position after the coordinate transformation on the photosensitive drum based on the correction shift amount CS corresponding to the surface number N, the convolution function, and the pixel position after the coordinate transformation of the original image (Step S803). The CPU 303 initializes a position Py in the main scanning direction (hereinafter referred to as "main scanning position") to 1 (Step S804). The CPU 303 obtains pixel data within a range of the spread L of the convolution function relating to the main scanning position Py (Step S805). The CPU 303 multiplies the calculated coefficient by the image data and adds up all of multiplied values to perform the convolution operation through product-sum operation (Step S806). The CPU 303 stores the corrected image data obtained through the convolution operation in the RAM 307. The CPU 303 adds 1 to the main scanning position Py (Step S807). The CPU 303 determines whether or not the main scanning position Py is a last pixel Pyend in the main scanning direction (Step S808). When the main scanning position Py is not the last pixel Pyend (NO in Step S808), the CPU 303 returns the processing to Step S805 and repeats the processing of Step S805 to Step S807.

When the main scanning position Py is the last pixel Pyend (YES in Step S808), the CPU 303 determines that the convolution operation has been completed for all of pixels in the main scanning direction of one scanning line. The CPU 303 adds 1 to the sub-scanning position Px (Step S809). The CPU 303 determines whether or not the sub-scanning position Px is the last scanning line Pxend in the sub-scanning direction (Step S810). When the sub-scanning position Px is not the last sub-scanning line Pxend (NO in Step S810), the CPU 303 returns the processing to Step S802. When the next surface number N is read, the CPU 303 repeats the processing of Step S802 to Step S809 for the scanning line at the next sub-scanning position Px. Meanwhile, when the sub-scanning position Px is the last sub-scanning line Pxend (YES in Step S810), the CPU 303 determines that the convolution operation has been completed for all of the scanning lines. The CPU 303 completes the convolution operation.

According to the embodiment, the convolution operation for image data is performed based on the correction shift amount CS for each reflection surface to correct the gravity center position of the image to an ideal position. Thus, image failure caused by the deviation of writing start position of the electrostatic latent image for each reflection surface of the rotary polygon mirror 204 can be prevented.

(Control Operation for Image Formation)

Figure 19:
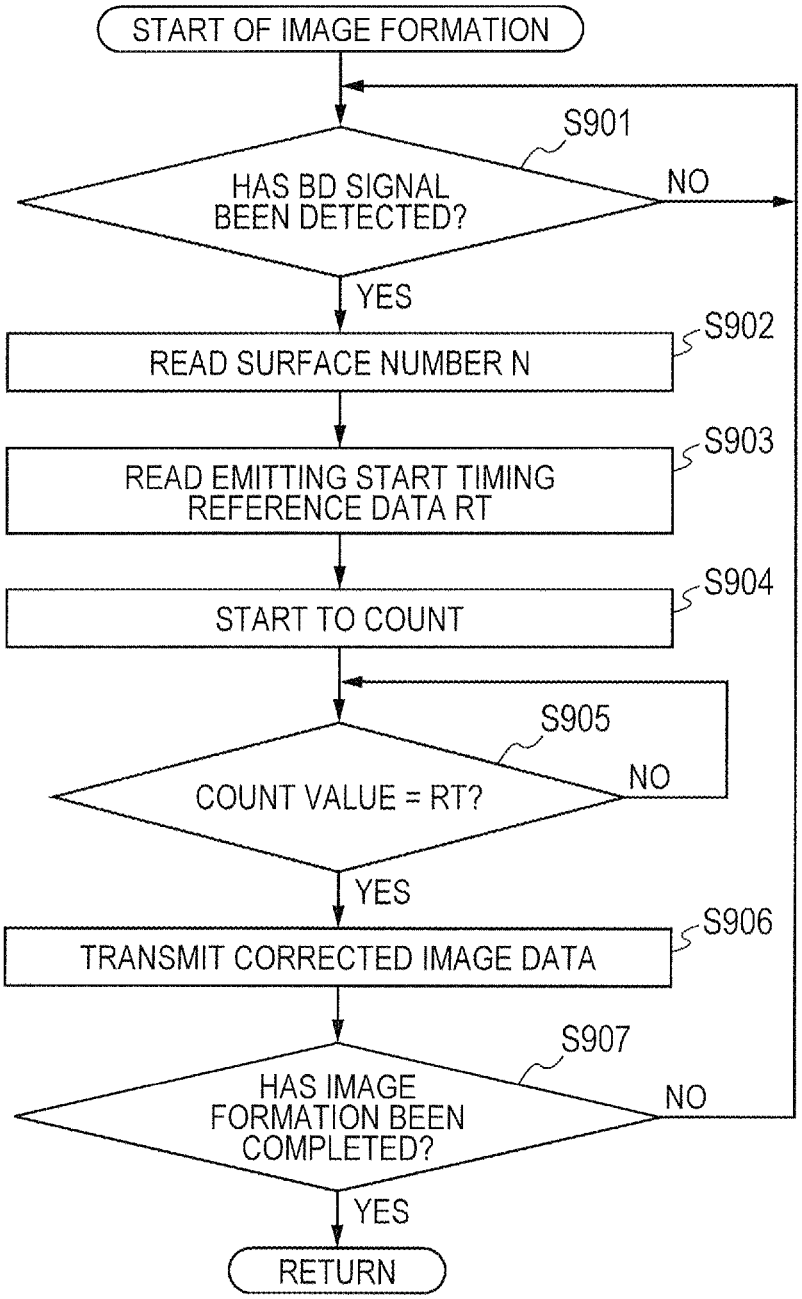
FIG. 19 is a flowchart for illustrating a control operation for image formation, which is executed by the CPU of the second embodiment.
Figure 20A:
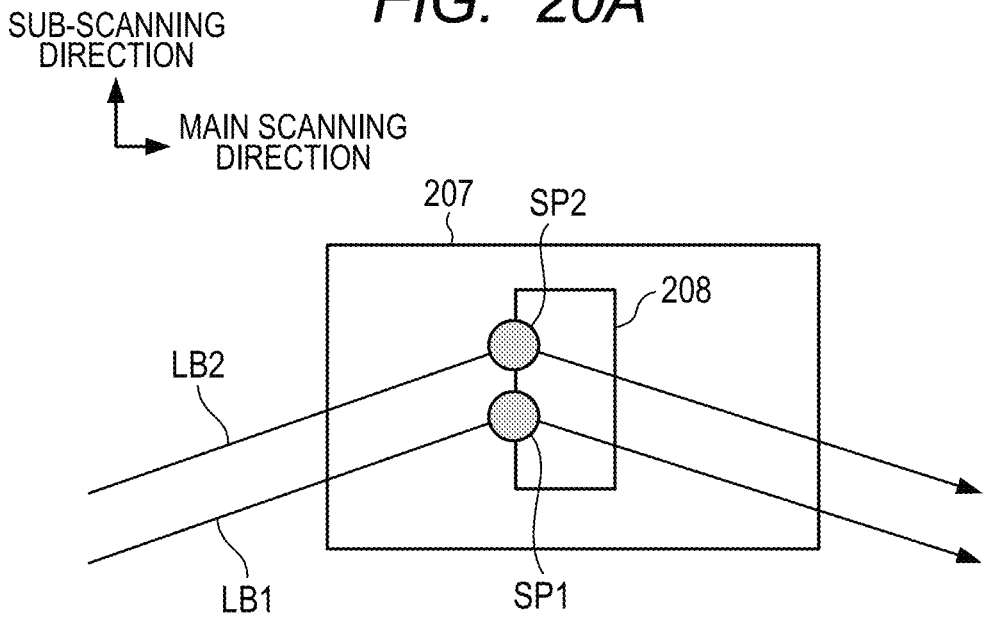
FIG. 20A and FIG. 20B are views for illustrating positions of spots of light beams which enter a beam detector.
Figure 20B:
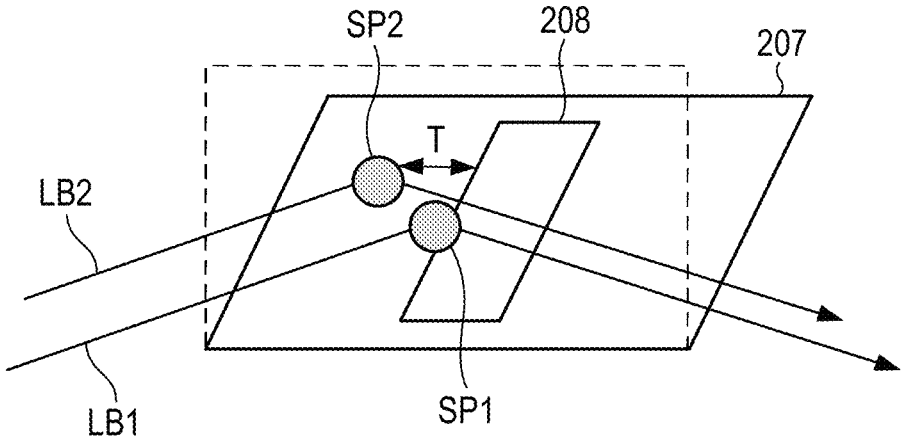

FIG. 19 is a flowchart for illustrating the control operation for image formation, which is executed by the CPU 303 of the second embodiment. The CPU 303 executes image formation based on the program stored in the ROM 308.

The control operation for the image formation illustrated in FIG. 19 is executed (Step S603 of FIG. 12) after the correction of the image data (Step S602) illustrated in FIG. 12. When the control operation for the image formation is started, the CPU 303 determines whether or not the BD signal has been detected (Step S901). When the BD signal has not been detected (NO in Step S901), the CPU 303 returns the processing to Step S901. When the BD signal has been detected (YES in Step S901), the CPU 303 reads the surface number N stored in the RAM 307 (Step S902). The surface number N of the reflection surface of the rotary polygon mirror 204 is updated by the CPU 303 each time the BD signal is input as described above. The CPU 303 reads the emitting start timing reference data RT corresponding to the surface number N from the RAM 307 (Step S903). At this time, the correspondence relation between the surface numbers N and the reference surface numbers Nref has already been identified, and hence the CPU 303 can read, from the RAM 307, the emitting start timing reference data RT corresponding to the surface number N currently deflecting the light beam.

The CPU 303 starts counting in accordance with the CLK signals (clock) input from the clock generator 310 (Step S904). The CPU 303 determines whether or not the count value matches with the emitting start timing reference data RT corresponding to the surface number N (Step S905). When the count value does not match with the emitting start timing reference data RT (NO in Step S905), the CPU 303 returns the processing to Step S905. When the count value matches with the emitting start timing reference data RT (YES in Step S905), the CPU 303 transmits corrected image data for one scanning in the main scanning direction to the light source drive circuit 304 (Step S906). The corrected image data is transmitted in a sequential manner one pixel after another to the light source drive circuit 304 from the corrected image data corresponding to a scanning start position at time intervals corresponding to printing time for each pixel. The light source drive circuit 304 controls the light source 201 in accordance with the corrected image data to emit the light beam from the light source 201. Through the formation of the electrostatic latent image in accordance with the corrected image data, the banding caused by positional deviation for each reflection surface can be prevented.

The CPU 303 determines whether or not the image formation has been completed (Step S907). When the image formation has not been completed (NO in Step S907), the CPU 303 returns the processing to Step S901. The CPU 303 repeats the processing from Step S901 to Step S906 to perform image formation of next scanning. When the image formation has been completed (YES in Step S907), the CPU 303 completes the control operation for the image formation.

According to the embodiment, image failure caused by the deviation of writing start position of the electrostatic latent image for each reflection surface of the rotary polygon mirror 204 due to the temperature rise in the image forming apparatus 100 is prevented, thereby being capable of forming a high quality image without uneven image density.

Through the calculation of the correction amount (positional deviation amount in the main scanning direction) Tofset before the image formation, the correction amount Tofset can be calculated under a condition in which the temperature condition in the image forming apparatus 100 is substantially equal at the time of calculating the correction amount Tofset and during the image formation. With this, optimum correction amount Tofset can be calculated.

According to the embodiment, the uneven image density which is caused by the deviation of writing start position of the electrostatic latent image for each reflection surface can be corrected based on the BD signals (detected signals) of the BD (beam detector) 207. The gravity center of the image data is corrected so as to be shifted for each reflection surface of the rotary polygon mirror 204 based on the BD signal intervals of the BD signal output from the BD 207, thereby being capable of preventing occurrence of the uneven image density even when the position of the BD 207 is shifted due to the temperature rise.

According to the embodiment, the uneven image density which is caused by the deviation of writing start position of the electrostatic latent image for each reflection surface can be corrected based on the detected signals of the beam detector.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-065459, filed Mar. 29, 2016, which is hereby incorporated by reference herein in its entirety.

What is claimed is:

1. An image forming apparatus, comprising:

a light source configured to emit a light beam;

a rotary polygon mirror having a plurality of reflection surfaces and being configured to deflect the light beam so that the light beam emitted from the light source scans on a surface of a photosensitive member;

a beam detector configured to receive the light beam reflected by each of the plurality of reflection surfaces to output a pulse;

a pulse interval measurement unit configured to measure a pulse interval of pulses output from the beam detector respectively corresponding to the plurality of reflection surfaces, wherein the pulse interval measurement unit measures the pulse interval between two pulses generated continuously, and makes a measurement result correspond to each of the plurality of reflection surfaces;

a reflection surface identification unit configured to identify each of the plurality of reflection surfaces;

a storage portion configured to store a plurality of reference pulse intervals corresponding to the plurality of reflection surfaces, respectively;

a correction amount calculation unit configured to calculate a correction amount based on a difference between the pulse interval measured by the pulse interval measurement unit and a corresponding one of the plurality of reference pulse intervals corresponding to the plurality of reflection surfaces, respectively, identified by the reflection surface identification unit; and a light source control unit configured to control an emitting start timing of the light source based on the correction amount calculated by the correction amount calculation unit, wherein the emitting start timing is a timing corresponding to a writing start position of an image in a main scanning direction of the light beam during one scan period of the light beam.

2. An image forming apparatus according to claim 1, wherein the light source control unit generates corrected image data based on the correction amount and controls the emitting start timing of the light source to emit the light beam in accordance with the corrected image data.

3. An image forming apparatus according to claim 1, wherein the correction amount calculation unit calculates the correction amount when the rotary polygon mirror is rotated at a predetermined speed before image formation by the image forming apparatus.

4. An image forming apparatus according to claim 1, further comprising an FG pulse generation unit configured to output FG pulses in accordance with rotation of a motor configured to rotate the rotary polygon mirror, wherein the reflection surface identification unit identifies each of the plurality of reflection surfaces based on an interval between a pulse output from the beam detector and an FG pulse output from the FG pulse generation unit.

* * * * *